US010858889B2

(12) United States Patent
Lasater et al.

(10) Patent No.: US 10,858,889 B2
(45) Date of Patent: Dec. 8, 2020

(54) STEERING ASSEMBLY FOR DIRECTIONAL DRILLING OF A WELLBORE

(71) Applicant: Kinetic Upstream Technologies, LLC, Houston, TX (US)

(72) Inventors: Jeffrey Bowden Lasater, Houston, TX (US); George Brian Sutherland, The Woodlands, TX (US); Gary Dean Althoff, Houston, TX (US); John Harrison Farrah, Jr., Houston, TX (US)

(73) Assignee: Kinetic Upstream Technologies, LLC, Houston, TX (US)

( * ) Notice: Subject to any disclaimer, the term of this patent is extended or adjusted under 35 U.S.C. 154(b) by 0 days.

(21) Appl. No.: 16/378,421

(22) Filed: Apr. 8, 2019

(65) Prior Publication Data

US 2019/0301245 A1 Oct. 3, 2019

Related U.S. Application Data

(63) Continuation-in-part of application No. 14/797,623, filed on Jul. 13, 2015, now Pat. No. 10,253,567,
(Continued)

(51) Int. Cl.
*E21B 17/10* (2006.01)
*E21B 7/06* (2006.01)
(Continued)

(52) U.S. Cl.
CPC ..... *E21B 7/061* (2013.01); *E21B 7/062* (2013.01); *E21B 7/067* (2013.01);
(Continued)

(58) Field of Classification Search
CPC combination set(s) only.
See application file for complete search history.

(56) References Cited

U.S. PATENT DOCUMENTS 4,485,693 A * 12/1984 Heikkila ..... D21F 1/20 74/571.11
2013/0213713 A1 8/2013 Smith et al.
2014/0231136 A1* 8/2014 Winslow ..... E21B 7/06 175/24

FOREIGN PATENT DOCUMENTS

RU 940249520 A1 6/1996
RU 94035985 A1 7/1996
(Continued)

OTHER PUBLICATIONS

Federal Service for Intellectual Property, Official Action, Russian Application No. 2017115928/03 (027552),dated Apr. 16, 2019, pp. 1-7, Moscow, RU.

(Continued)

*Primary Examiner* — David J Bagnell
*Assistant Examiner* — Ronald R Runyan
(74) *Attorney, Agent, or Firm* — Pramudji Law Group PLLC; Ari Pramudji

(57) ABSTRACT

A steering assembly includes a housing having a longitudinal axis, a mandrel having a front connecting extremity and a rear connecting extremity, the mandrel passing through the housing and arranged in a first position coaxially to the longitudinal axis of the housing, a deflector device configured to exert a side force on the mandrel to offset the front connecting extremity of the mandrel from the longitudinal axis, and a tool face assembly configured to rotate the front connecting extremity of the mandrel in a desired direction.

19 Claims, 15 Drawing Sheets

Related U.S. Application Data which is a continuation of application No. 14/510,561, filed on Oct. 9, 2014, now Pat. No. 9,109,402.

(51) Int. Cl.
*E21B 47/024* (2006.01)
*E21B 44/00* (2006.01)

(52) U.S. Cl.
CPC ..... *E21B 17/1014* (2013.01); *E21B 17/1078* (2013.01); *E21B 44/005* (2013.01); *E21B 47/024* (2013.01)

(56) References Cited

FOREIGN PATENT DOCUMENTS

| | | |
|---|---|---|
| RU | 2105880 C1 | 2/1998 |
| RU | 2114273 C1 | 6/1998 |

OTHER PUBLICATIONS

PCT International Search Report and Written Opinion; PCT/US2020/027341; dated May 22, 2020.

* cited by examiner

600

STEERING ASSEMBLY FOR DIRECTIONAL DRILLING OF A WELLBORE

FIELD OF THE INVENTION

The present invention relates to the field of directional drilling systems and to a method for controlling the direction while drilling a vertical or horizontal wellbore. More particularly, the present invention is related to a steering assembly to be included in a drill string for directional drilling.

BACKGROUND

Directional drilling systems are systems well known in the art of drilling oil and gas wellbores. Such a system generally comprises a drillstring with a bottom hole assembly (BHA) comprising a steering assembly and a drill bit attached to the bottom end of the drillstring.

In directional drilling, the bottom hole assembly generally comprises a measurement while drilling assembly (MWD) comprising sensors for measuring information about the direction (inclination and azimuth) of the wellbore and other downhole drilling parameters, and comprises telemetry transmitters for transmitting sensor data uphole to a surface control unit. Additionally, for directional control, a conventional bottom hole assembly comprises a downhole motor and bent sub coupled to a shaft for rotating the drill bit. Optionally, a rotary steerable system (RSS) may either replace or be used in combination with the downhole motor to provide steering control. The advantage of the RSS is to allow directional steering control while rotating the entire drillstring, whereas the downhole motor alone is only steerable by holding the drillstring fixed in a particular direction (or toolface) from the surface. The benefits of continuously rotating the drillstring are numerous including a large reduction in friction between the drillstring and the borehole, which permits the drilling of longer distance horizontal wells.

Rotary Steerable Systems generally comprise a tubular housing enclosing a shaft having a front end connected directly or indirectly to the drill bit. Various kinds of steering mechanisms can be included in the housing to change the orientation of the front end of the shaft to change the direction of drilling. A first category of rotary steerable systems is configured to work in a "push the bit" mode, and a second category of rotary steerable systems is configured to work in a "point the bit" mode. In push the bit mode, the bit dominant factor of steering is a side (or lateral) force imparted to the bit. In point the bit mode, the dominant factor for steering is an angular change or tilting of the bit. Each category of rotary steerable systems is comprised of further sub-categories.

For the rotary steerable systems configured to work in push the bit mode, the housing comprises pads or some other offset mechanism which can be selectively activated for applying a reactive side force on the shaft, thus changing the orientation of the drill bit.

A first sub-category of push the bit rotary steerable systems comprises a non-rotating (or slowly rotating) housing provided by a plurality of pads distributed around the circumference of the housing and directed towards the wellbore. The pads are selectively actuated to push against the wellbore formation and change the orientation of the housing which deflects the shaft and provides the required side force on the drill bit, thus deflecting the drill bit sideways in a preferred direction of drilling.

A second sub-category of push the bit rotary steerable system comprises a non-rotating (or slowly rotating) housing provided by a fixed body-mounted stabilizer and a deflection device inside the circumference of the housing and directed towards the shaft. The internal deflection device is selectively actuated to push the shaft away from the center of the stabilized housing and thus the center of the wellbore, providing a side force on the drill bit.

Another sub-category of push the bit rotary steerable system comprises a rotating housing provided by a plurality of pads distributed around the circumference of the housing and directed towards the wellbore. The pads rotate with the housing and can independently move from a retracted to an extended position, bearing against the wellbore formation and pushing the housing laterally off-center from the wellbore, thus changing its orientation. The system further comprises a control means that actuates one pad when the pad crosses a selected radial angle such that the pad pushes against the wellbore towards a selected direction to change the orientation of the housing which deflects the shaft and provides the required offset force at the drill bit. While drilling in soft formations, it may not be suitable to use a steering system which pushes pads against the wellbore, especially when rotating said pads.

For the rotary steerable systems configured to operate in point the bit mode, the primary method used to tilt the drill bit is to bend the shaft inside a centralized non-rotating (or slowly rotating) housing, thus angularly deflecting the shaft away from the centerline axis of the wellbore. In that case, the non-rotating housing includes some form of anti-rotation means and a mechanism for deflecting the shaft inside the non-rotating housing. In this case, bending while rotating the shaft can cause fatigue on the shaft, and the shaft may break or get deformed after a certain time of use. Workarounds include the use of costly materials and may require an increased shaft diameter this limiting the available cross-section for offset mechanisms, power, and instrumentation.

Beside the category of "push the bit" and "point the bit" rotary steerable systems, there also exist hybrid rotary steerable systems that are capable of steering like both a push the bit and point the bit system, depending on configuration. An example of such a hybrid rotary steerable system is disclosed in U.S. Pat. No. 7,188,685. This rotary steerable system comprises an upper section connected to a steering section and a drill bit connected to the steering section. The upper section is connected to a collar on which an upper stabilizer is provided. The steering section comprises a lower stabilizer and is connected to the upper section by a swivel which is a two degree of freedom universal joint, such that the swivel is located between the lower stabilizer and the drill bit. Pistons are located between the steering section and the upper section and are actuated to push against the steering section which pivots on the universal joint. The steering section tilts until the lower stabilizer contacts the formation at which point the pistons act to push the bit through the formation. As the formation is drilled, the constraint imposed by the formation is removed, the periphery of the steering section is allowed to tilt further and the tool then begins to steer as a point the bit system. Rotation of the steering section against the pads causes friction that can produce wear of those parts and vibration of the steering section which can influence the quality of the borehole.

It is desirable to provide a rotary steerable system that doesn't present the drawbacks of prior art devices, and which provides:

- wellbore steering in either push the bit or point the bit mode;

a point the bit mode which minimizes internal cyclic bending stresses;

relatively high turn rates (or dogleg severity);

a configuration that is easily field serviceable;

the capability to vary turn rate (or dogleg severity) while providing independent directional tool face control and;

good control of the direction of drilling with less vibration.

SUMMARY OF THE INVENTION

According to a first aspect, the present invention is related to a Steering assembly 100 comprising a housing 136 having a longitudinal axis 101 and a mandrel 102 comprising a front connecting extremity 103 and a rear connecting extremity 104, the mandrel 102 passing through the said housing 136 and arranged in a first position coaxially to the said longitudinal axis 101 of the housing 136, the steering assembly being characterized in that it comprises:

a deflector device for giving a side force to the said mandrel 102 such as to bring the said front connecting extremity 103 of the said mandrel 102 offset from the said longitudinal axis 101, and a tool face assembly for rotating the said front connecting extremity 103 of the said mandrel 102 towards a desired direction;

the said mandrel 102 being rotatable relative to the said housing, the said deflecting assembly and the said tool face assembly.

Preferably, the mandrel 102 is connected to the housing 136 through a bearing pack comprising a spherical seat 105 arranged around a set of ball bearings 130.

Preferably, the said toolface assembly comprises:

an orienting sleeve 106 at least partially included in the said housing 136 and arranged around the said mandrel 102, the said orienting sleeve 106 comprising a first sleeve section 106*a* having a bore coaxial with the said longitudinal axis 101 of the housing 136 and a second sleeve section 106*b* having a bore coaxial to a second axis 137 inclined relative to the said longitudinal axis 101 of the housing 136; and an actuating system for rotating the said orienting sleeve 106;

Preferably, the said deflector device is a deflecting assembly comprising:

a deflecting sleeve 107 arranged around the said mandrel 102 and coaxially to the said second axis 137 and;

an actuating system for moving the said deflecting sleeve 107 along the said second axis 137.

Preferably, the said actuating system for rotating the said orienting sleeve 106 comprises a first geared actuator 108 that engages a geared surface 109 of the said orienting sleeve 106.

Preferably, the said actuating system for moving the said deflecting sleeve 106 along the said second axis 137 comprises:

a first actuating sleeve 110 surrounding the said mandrel 102 and at least partially included into the said first sleeve section 106*a* of the orienting sleeve 106, the said first actuating sleeve 110 comprising:

a geared surface 111, and a geared extremity 112 directed towards the bore of the second sleeve section 106*b* of the said orienting sleeve 106;

a second geared actuator 113 that engages the said geared surface 111 of the first actuating sleeve 110;

a second actuating sleeve 114 surrounding the said mandrel 102, included into the said second sleeve section 106*b* of the orienting sleeve 106, retained by an abutment 115 into the said second sleeve section 106*b* and disposed around the said deflecting sleeve 107, the second actuating sleeve 114 comprising:

a geared extremity 116 that engages the said geared extremity 112 of the said first actuating sleeve 110 and;

a spiral guiding means 117 provided on its the inner surface;

a linear guiding means 118 provided into the said second sleeve 106*b* section of the orienting sleeve 106;

Preferably, the said deflecting sleeve 107 comprises:

a first side comprising a spiral cam follower 119 that engages into the said spiral guiding means 117 in the second actuating sleeve 114;

a second side comprising a second cam follower 120 that engages with the said linear guiding means 118.

Preferably, an assembly of a spherical seat 121*a* and ball bearing 121*b* is arranged between the said deflecting sleeve 107 and the said mandrel 102.

Preferably, the external surface of the said housing 136 further comprises bore contact pads 122.

Preferably, the said housing 136 further comprises one or more enclosures 123 including a battery 124, a control electronic assembly 125 and a motor 126, 127.

Preferably, the steering assembly comprising a first motor 126 and a first geared actuator 108 dedicated for rotating the said orienting sleeve 106, and a second motor 127 and a second geared actuator 113 dedicated for rotating the first actuating sleeve 110 of the actuating system for actuating the deflecting sleeve 107.

In a first possible configuration, the steering assembly further comprises a pivot stabilizer sub 131 connected to the said rear extremity 104 of the mandrel 102.

In a second possible configuration, the steering assembly further comprises a pivot sub 135 connected to the said front extremity 103 of the mandrel 102 and connected to a near bit stabilizer sub 133 having its blades 134 away from the pivot point 139 of the pivot sub 135, and itself connected to a drill bit 200.

Preferably, the said housing is configured for not rotating in the wellbore and serves as a reference point for steering the bit.

More preferably, the steering assembly further comprises a control electronic assembly 125 configured for measuring any undesirable rotation of the housing in the wellbore, calculating the correction to apply to steer the bit in the desired direction and to apply these corrections to the said deflecting assembly and tool face assembly.

In a second aspect, the present invention relates to a method for directionally drilling a wellbore by providing the steering assembly 100 in a drillstring as presented in the present disclosure, and wherein the magnitude of the directional steering is changed by operating the said deflector device.

In the method of the present invention, the steering direction can be further changed by operating the said tool face assembly.

In a first embodiment of the method of the present invention, the said steering assembly 100 is used in a push the bit configuration with the said front extremity 103 of the mandrel 102 connected to a drill bit 200.

In a second embodiment of the method according to the present invention, the said steering assembly 100 is used in a point the bit configuration wherein the said front extremity 103 of the mandrel 102 is connected to a second pivot sub 135 itself connected to a near-bit stabilizer sub 133, itself connected to a drill bit 200.

The present invention can also be described as a steering assembly 100 comprising a housing 136 having a longitudinal axis 101 and a mandrel 102 comprising a front connecting extremity 103 and a rear connecting extremity 104, the mandrel 102 passing through the said housing 136 and arranged in a first position coaxially to the said longitudinal axis 101, a deflector device for giving a side force to the said mandrel 102 in the housing 136 such as to bring the said front connecting extremity 103 of the said mandrel 102 offset from the said longitudinal axis 101, characterized in that it further comprises a pivot stabilizer sub connected to the rear extremity of the mandrel.

Preferably, the said pivot stabilizer sub is arranged outside of the housing.

In another embodiment of the invention, the front extremity 103 of the mandrel 102 is connected to a pivot sub 135, itself connected to a near bit stabilizer 133 which is directly connected to a drill bit 200. Further, the near bit stabilizer and the bit may be combined into one unit.

Preferably, the said housing is configured for not rotating or slowly rotating within the wellbore and serves as a reference point for steering the bit.

Preferably, the steering assembly comprises:

- a deflector device for producing a side force to the said mandrel 102 into the housing 136 such as to bring the said front connecting extremity 103 of the said mandrel 102 offset from the said longitudinal axis 101, and
- a tool face assembly for rotating the said front connecting extremity 103 of the said mandrel 102 towards a desired direction;

the said mandrel 102 being rotatable relative to the said housing, the said deflector device and the said tool face assembly.

Preferably, the steering assembly comprises a control device configured for measuring any undesirable rotation of the housing in the wellbore, calculating a correction to apply to steer the bit in the desired direction and to apply these corrections to the said deflector device and tool face assembly.

In a method for drilling directionally a wellbore according to the present invention, a steering assembly 100 such as presented in the present disclosure is provided in a drill string, and the magnitude of the direction of drilling is changed by providing a side force on the said mandrel. In the said method, the tool face assembly can be operated for changing the tool face of the drill bit.

DETAILED DESCRIPTION

Figure 1A:
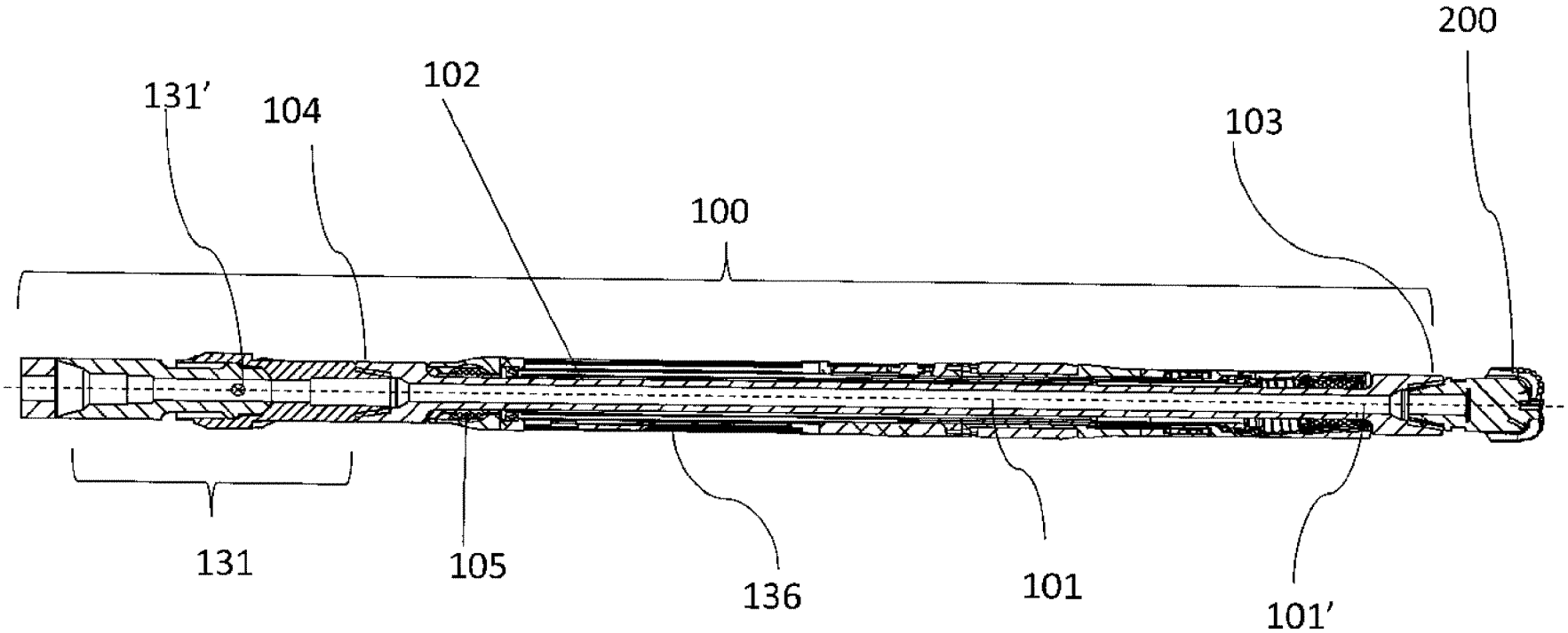
FIG. 1*a* shows a cross sectional view of a steering assembly according to an embodiment of the present invention, the steering assembly being connected to a drill bit.

According to a first aspect, the present invention relates to a steering assembly 100 to be included in a drill string for steering a drill bit in a directional wellbore.

A steering assembly according to the present invention comprises a housing 136 having a longitudinal axis 101 and a mandrel 102 comprising a front connecting extremity 103 for connection to a drill bit 200 and a rear connecting extremity 104 for connection to a drill string, the mandrel 102 passing through the said housing 136 and being arranged in a first position coaxially to the said longitudinal axis 101. The steering assembly being characterized in that it comprises:

- a deflector device for pivoting the said mandrel 102 in the housing 136 or in other words to give a side force on the mandrel such as to bring the said front connecting extremity 103 of the said mandrel 102 offset from the said longitudinal axis 101, and
- a tool face assembly for rotating the said front connecting extremity 103 of the said mandrel 102 towards a desired direction;

the said mandrel 102 being rotatable relative to the said housing, the said deflecting assembly and the said tool face assembly.

Preferably, the deflector device is a deflecting assembly as presented herein above. Alternatively, the deflector device can be any deflector device known by the man skilled in the art such as for example pistons or pads arranged in the housing 136 to push the mandrel 102 and actuated by an actuator.

The FIG. 1*a* presents a cross sectional view of an embodiment of a steering assembly configured in a "push the bit" mode. The term "push the bit" is used as reference to the configurations "push the bit" of the prior art steering systems wherein a side force is applied on the mandrel to change the offset of the mandrel relative to the axis of the housing. In the present invention, bending of the mandrel is minimized by connecting the rear extremity 104 of the mandrel 102 to a pivot stabilizer sub 131 such that when a side force is applied on the mandrel 102, the mandrel rotates relative to the pivot point and the front extremity 103 of the mandrel 102 gets offset from the axis of the housing. The front extremity of the mandrel is connected to a drill bit 200.

Advantageously, the pivot stabilizer sub 131 is arranged outside of the housing 136. This arrangement simplifies the construction and the manufacturing of the steering assembly, and the pivot stabilizer sub 131 can be removed and replaced easily. The pivot stabilizer sub 131 also gives more flexibility to the steering assembly and a wellbore can be drilled with higher doglegs.

Figure 1B:
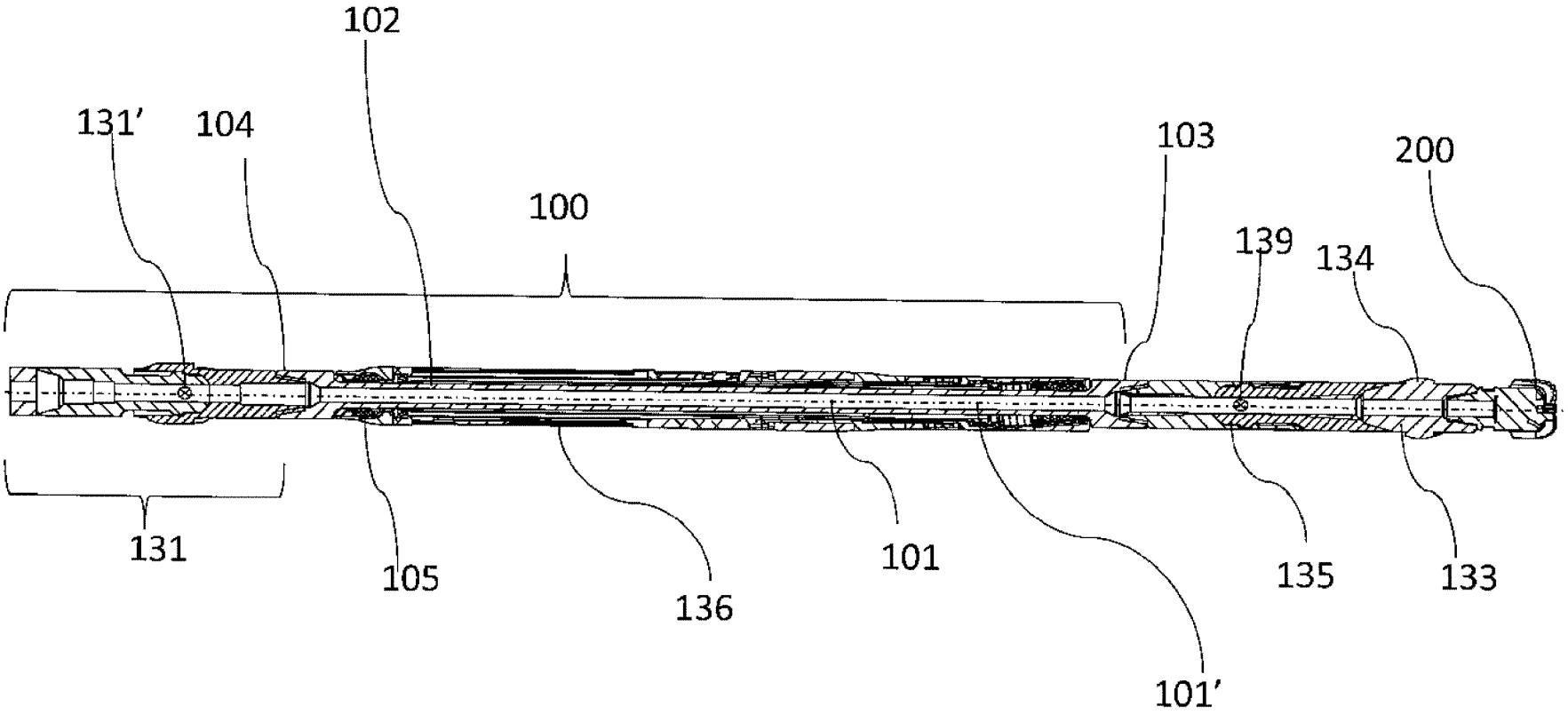
FIG. 1*b* shows a cross sectional view of a steering assembly according to an embodiment of the present invention, the steering assembly being connected to a pivot stabilizer sub itself connected to a drill bit.

The FIG. 1*b* presents a cross sectional view of a the same steering assembly represented in FIG. 1*a* with additional means arranged between the front end 103 of the mandrel 102 and the drill bit 200 such that the steering assembly is configured in a "point the bit" mode. The rear extremity 104 of the mandrel 102 is connected to a first pivot stabilizer sub 131 and the front extremity 103 of the mandrel 102 is connected to a pivot sub 135, which is connected to a near bit stabilizer 133, which is connected to a drill bit 200. The near bit stabilizer 133 has blades 134 located away from the pivot point 139 of the pivot sub 135, in order to obtain a better "point the bit effect" wherein the blades acts as a pad stabilizer preventing the side of the bit to cut the formation and maintaining borehole centralization at that point. In that configuration, when a force is applied on a lateral side of the mandrel 102, the mandrel rotates about the pivot point 131' of the pivot stabilizer sub 131, the front extremity 103 of the mandrel points towards a first direction at an angle $\alpha$ relative to the longitudinal axis 101 of the housing 136. The pivot sub 135 allows the drillstring to dislocate from the center or the wellbore. A fulcrum formed by the near bit stabilizer 133 and the wall of the wellbore causes the drill bit to point towards a second direction at an angle $\beta$ relative to the longitudinal axis 101 of the housing, wherein the angle $\beta$ is directly proportional to $\alpha$ but in the opposite direction, depending on the distance between the fulcrum point and the bit.

These both aforementioned configurations present the advantage that the mandrel 102 is not bent while applying changes to the orientation of the drill bit so that the fatigue on the mandrel is reduced, and therefore the durability of the steering assembly and the directional control of the drill bit are improved. Advantageously, the pivot sub 135 is also outside the housing 136 to simplify the construction of the steering assembly and to facilitate maintenance.

Figure 2A:
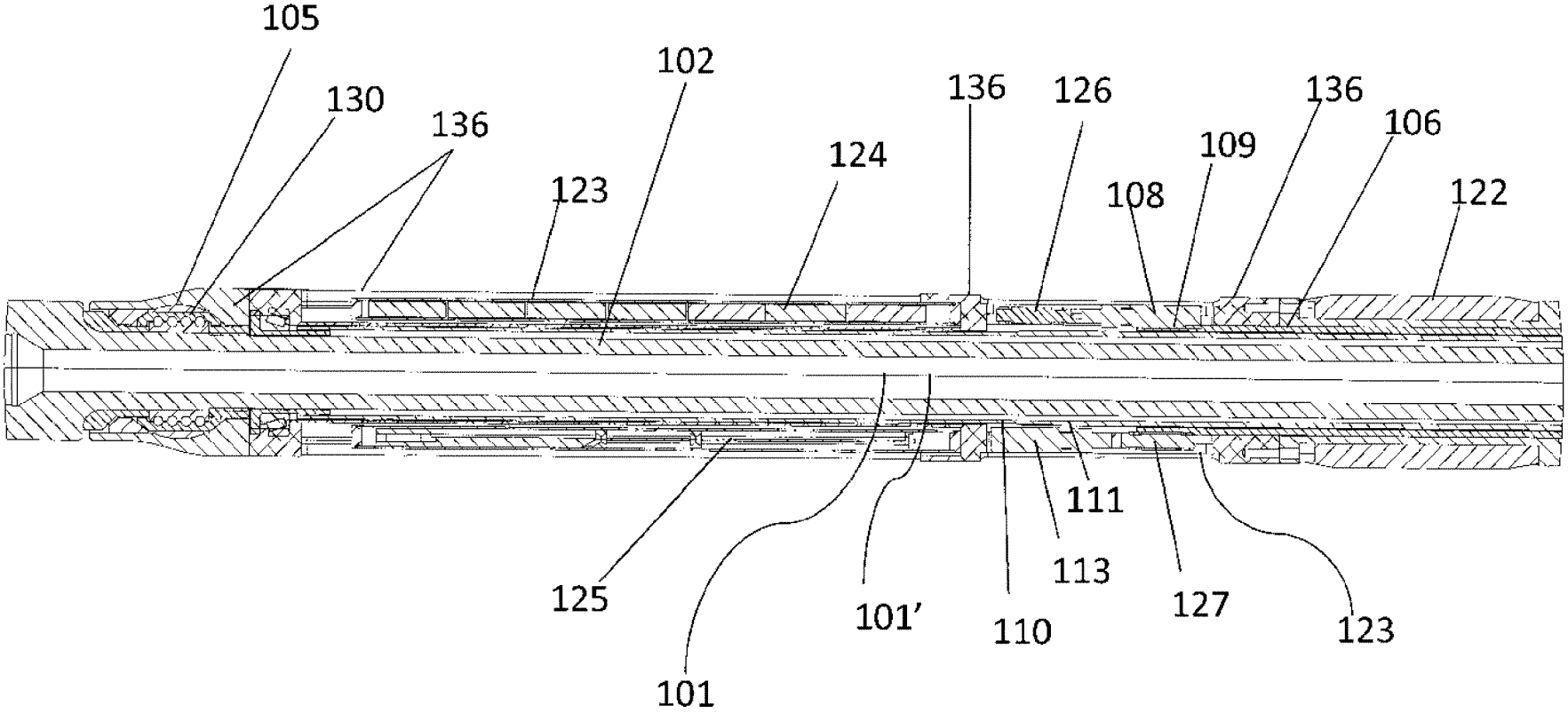
FIG. 2*a* shows an enlarged cross sectional view of a first section of the steering assembly according to the embodiments presented in FIGS. 1*a* and 1*b*.

The FIG. 2*a* shows an enlarged view of a first section of the steering assembly according to an embodiment of the present invention. The mandrel 102 is connected to the housing 136 through a bearing pack comprising a spherical seat 105 connected to the inner surface of the housing 136 and arranged around a set of ball bearings 130 that allows free rotation of the mandrel 102 relative to the housing 136. The spherical seat 105 is arranged between the mandrel 102 and the housing 136 such as to allow pivotal movement of the mandrel 102 relative to the housing 136 and provides radial and/or axial load coupling between the mandrel 102 and the housing 136. Preferably, the bearing pack is arranged in the vicinity of the rear end of the housing and the rear extremity 104 of the mandrel 102.

Figure 5:
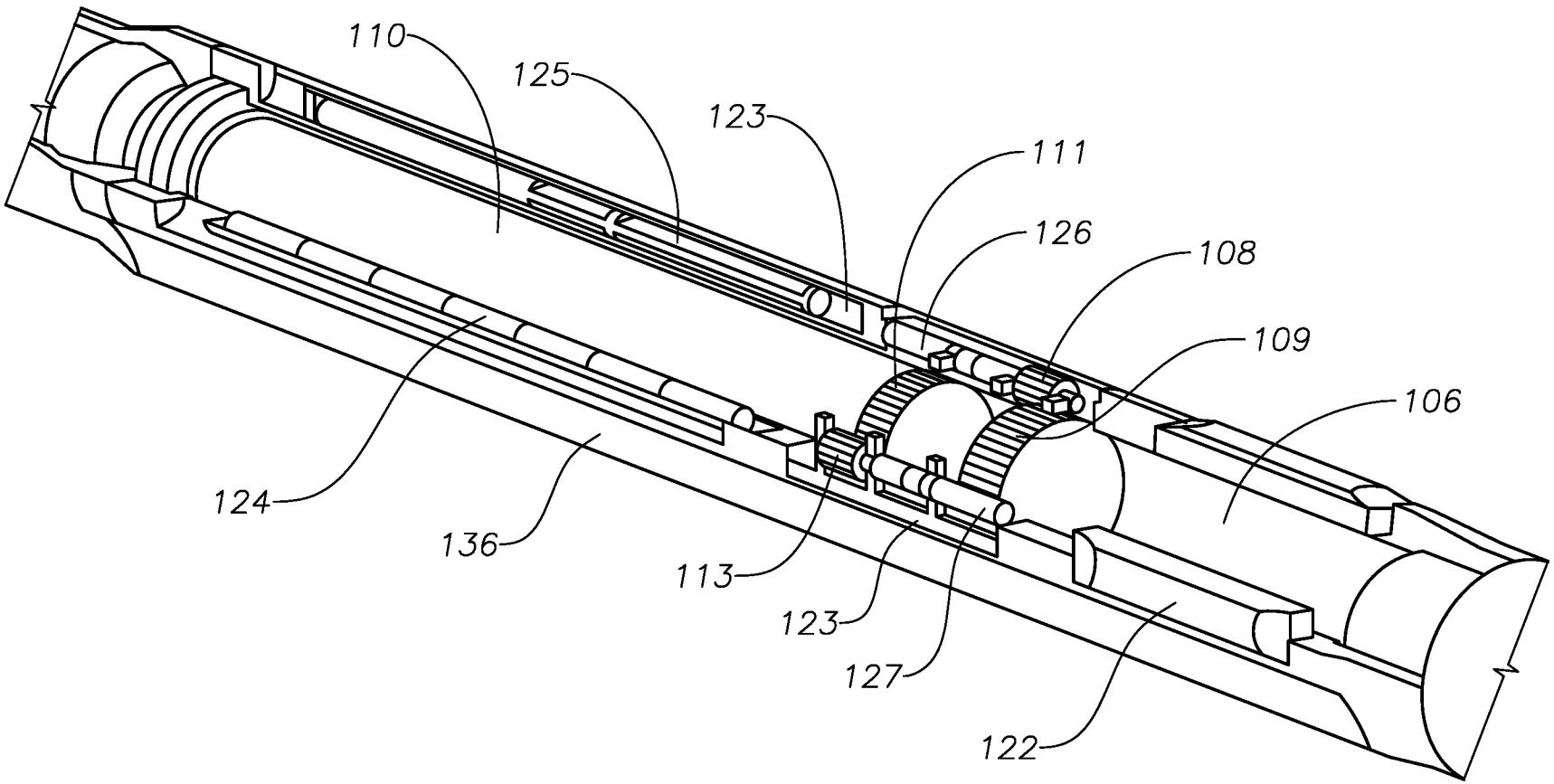
FIG. 5 shows a three dimensional view of the inside of the first section of the steering assembly presented in FIG. 2*a*.

A more detailed three dimensional view of the inside of the housing 136 is presented in FIG. 5. The housing 136 comprises compartments or enclosures 123 for arranging one or more batteries 124, control electronics assemblies 125 and motors 126 and 127 for communicating with the surface and operating the deflecting assembly and the tool face assembly.

Figure 2B:
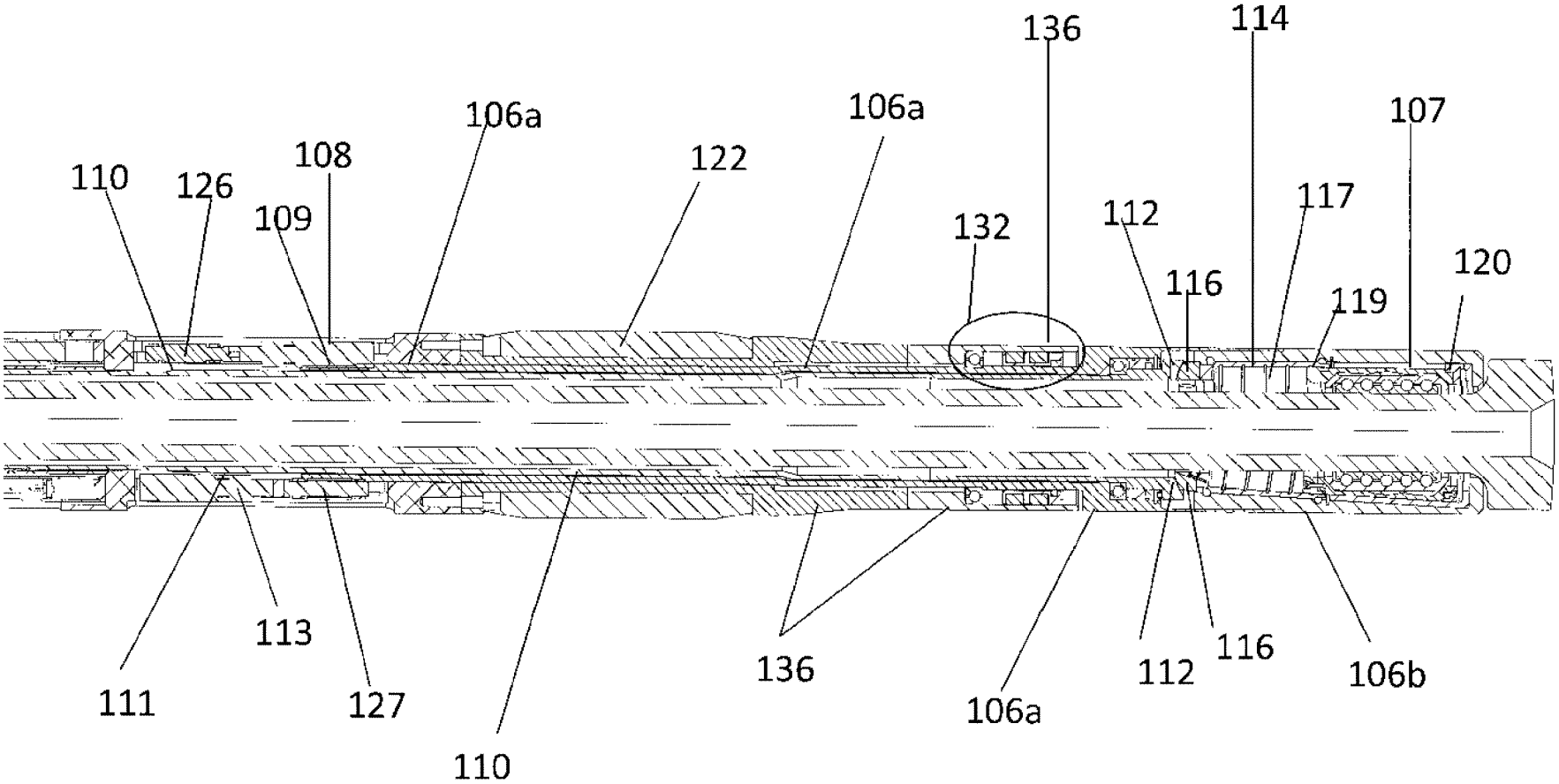
FIG. 2*b* shows an enlarged cross sectional view of a second section of the steering assembly according to the embodiments presented in FIGS. 1*a* and 1*b*.

The FIG. 2*b* represents an enlarged view of a second section of the steering assembly showing the tool face assembly and the deflecting assembly. The said tool face assembly comprises an orienting sleeve 106 included in the said housing 136 and arranged around the said mandrel 102. The orienting sleeve 106 comprises a first sleeve section 106*a* having a bore coaxial with the longitudinal axis 101 of the housing and a second sleeve section 106*b* having a bore coaxial to a second axis 137 which is inclined relative to the said longitudinal axis 101 of the housing. Preferably, the outer surface of the second sleeve section 106*b* is cylindrically coaxial to the longitudinal axis 101 of the housing 136 and has an outer diameter adapted to prevent debris of the wellbore to penetrate within the housing. For example, the outer diameter of the second sleeve section 106*b* is superior or equal to the outer diameter of the end of the housing 136 carrying the orienting sleeve 106. Alternatively, the outer diameter of the second sleeve section 106*b* may be substantially equal or superior to the inner diameter of the end of the housing 136 carrying the orienting sleeve 106. Because of the inclination of the bore of the second sleeve section 106*b* along the second axis 137, the outer diameter of the second sleeve section 106*b* is superior to the diameter of the first sleeve section 106*a* of the orienting sleeve. To provide a more compact steering assembly, it is preferable that the orienting sleeve 106 be partially included in the housing 136, with the first sleeve section 106*a* arranged inside of the housing 136 and the second sleeve section 106*b* arranged outside of the housing 136. Preferably, at least one bearing, preferably a thrust bearing 132 is arranged between the housing 136 and the orienting sleeve 106. The toolface assembly further comprises an actuating system for rotating the orienting sleeve 106, the actuating system comprising preferably a first geared actuator 108 that engages a geared surface 109 of the orienting sleeve. The first geared actuator 108 is arranged in the housing 136 and can be powered by a motor 126. The geared surface 109 is preferably arranged at the outer surface of the first sleeve section 106*a* inside the housing.

The deflecting assembly comprises a deflecting sleeve 107 arranged around the said mandrel 102 and coaxially to the said second axis 137. Preferably, the deflecting sleeve is arranged inside the second sleeve section 106*b* of the orienting sleeve 106. The deflecting assembly further comprises an actuating system for moving the said orienting sleeve 107 along the said second axis 137.

Figure 3:
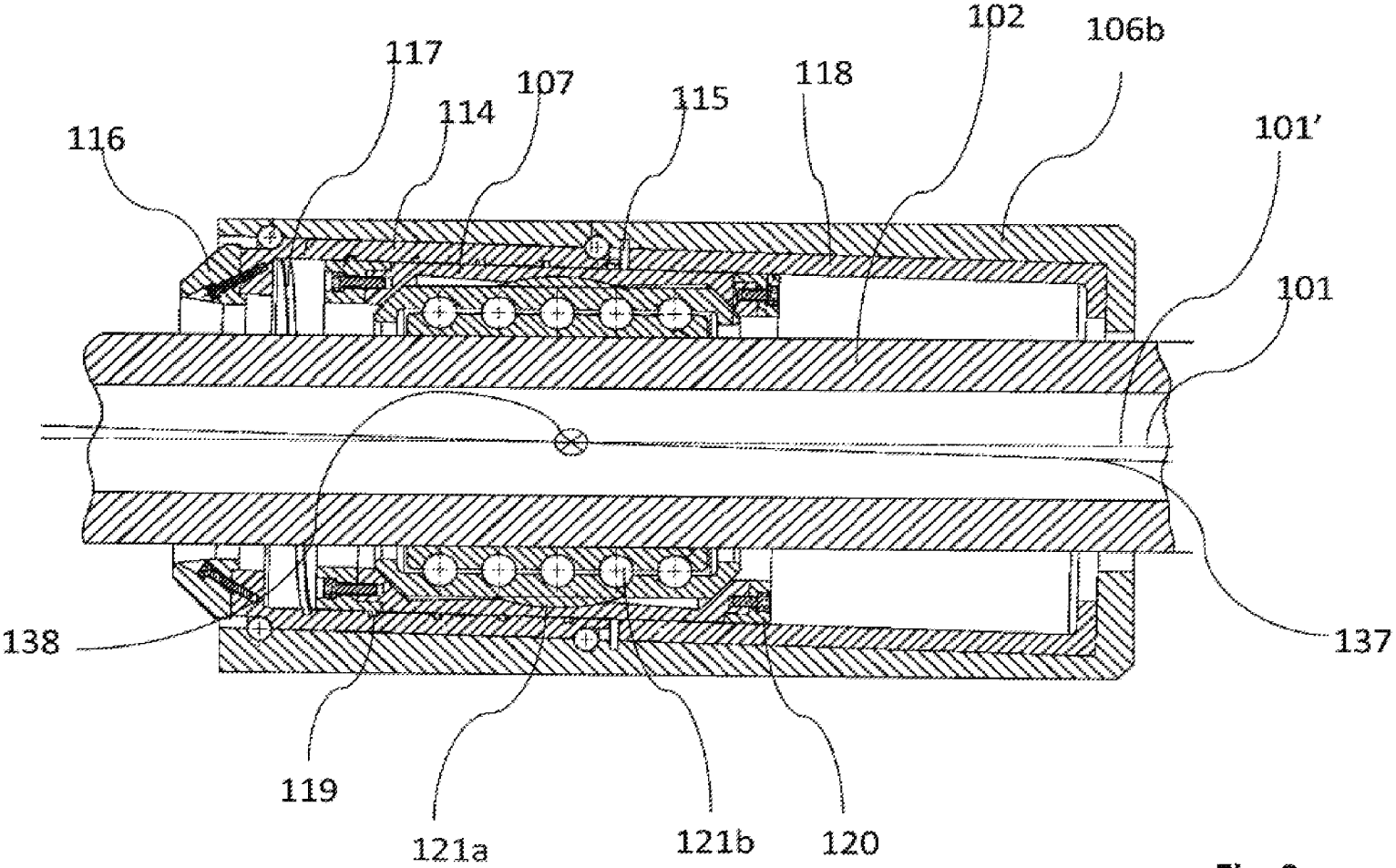
FIG. 3 shows an enlarged cross sectional view of a front section of the steering assembly according to the present invention.
Figure 4:
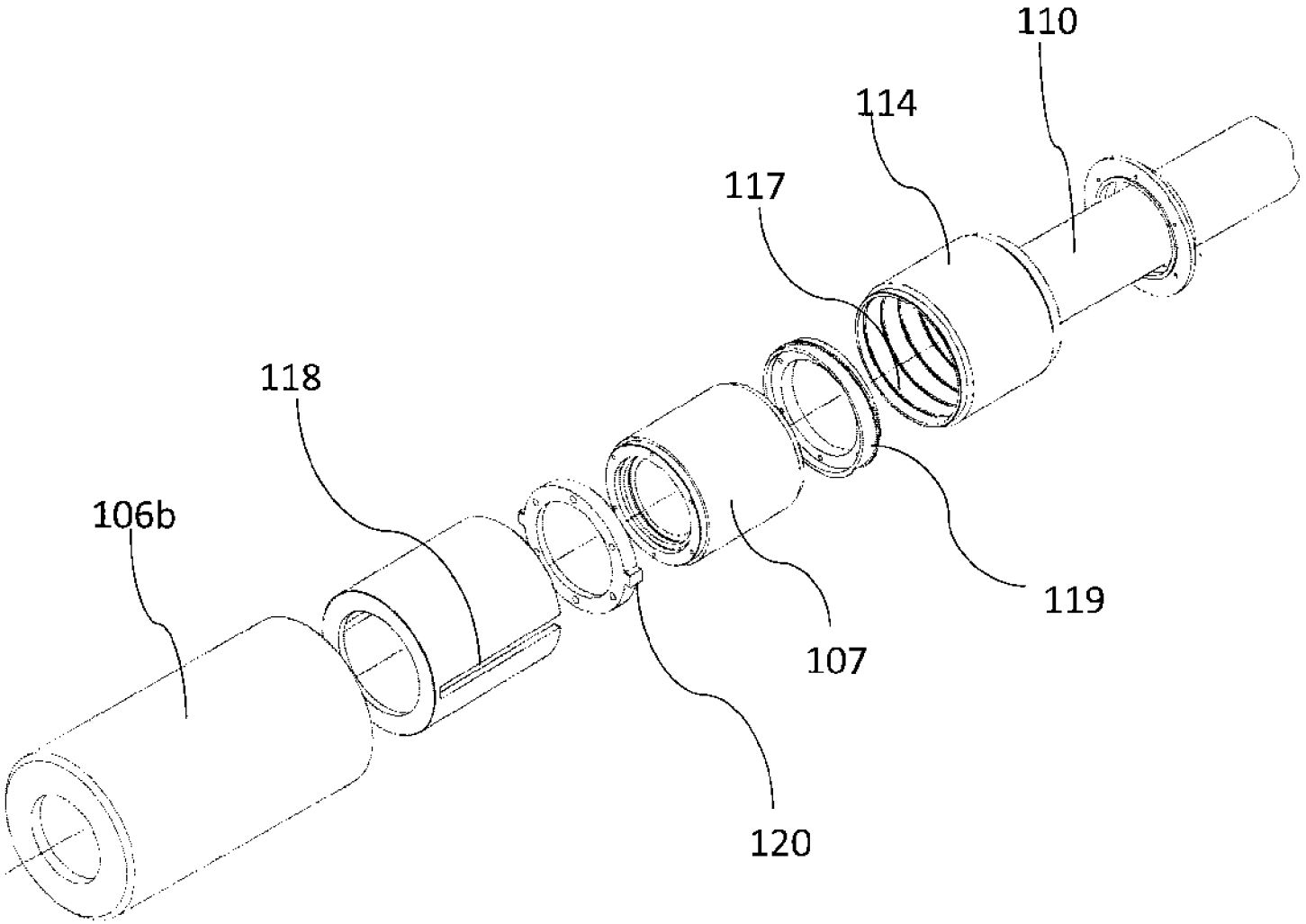
FIG. 4 shows a three dimensional exploded view of the front section of the steering assembly presented in FIG. 3.

An embodiment of an actuating system for moving the deflecting sleeve 107 is presented herein above in combination with the FIGS. 2*b*, 3 and 4. The actuating system for moving the deflecting sleeve 107 comprises a first actuating sleeve 110 that surrounds the mandrel 102 and that is at least partially included in the first sleeve section 106*a* of the orienting sleeve 106, so that the geared surface 111 can be engaged by a second geared actuator 113 arranged into the housing 136. The second geared actuator 113 can be powered by a second motor 127. The first actuating sleeve 110 further comprises a geared extremity 112 directed towards the bore of the second section 106*b* of the said orienting sleeve 106. A second actuating sleeve 114 is included inside the said second sleeve section 106*b* of the orienting sleeve 106, coaxially to the said second axis 137, and is retained by an abutment 115 into the said second sleeve section 106*b*.

The second actuating sleeve 114 surrounds the said deflecting sleeve 107 which is disposed around the said mandrel 102. The second actuating sleeve 114 comprises:

- a geared extremity 116 that engages the said geared extremity 112 of the said first actuating sleeve 110 and;
- a spiral guiding means 117 provided on its the inner surface.

The said deflecting sleeve 107 comprises:

- a first side comprising a spiral cam follower 119 that engages into the said guiding means 117 in the second actuating sleeve 114;
- a second side comprising a linear cam 120 that engages with a linear guiding means 118 provided in the said second sleeve 106*b* section of the orienting sleeve 106.

The deflecting sleeve 107 is connected to the mandrel 102 through a bearing pack comprising a spherical seat 121*a* and ball bearing 121*b*. The spherical seat 121*a* is arranged between the said deflecting sleeve 107 and the ball bearing 121*b* itself arranged around the said mandrel 102. A clearance between the inner surface of the deflecting sleeve 107 and the outer surface of the ball bearing 121*b* allows a rotational movement of the ball bearing 121*b* relative to the deflecting sleeve 107, centered on the axis 138 of the spherical seat 121*a*.

To deflect the mandrel axis 101' relative to the axis 101 of the housing, instructions are sent to the control electronic assembly 125 for actuating the second geared actuator 113 to rotate the first actuating sleeve 110 whose geared extremity 112 engages the mating geared extremity 116 of the second actuating sleeve 114 inclined relative to the first actuating sleeve 110. Said instructions are sent to the control electronic assembly for example via telemetry transmitters. The inner surface of the second actuating sleeve 114 comprises a spiral guiding means 117 engaging the spiral cam follower 119 of the deflecting sleeve 107. The spiral cam follower 119 is preferably arranged on the rear side of the deflecting sleeve 107 oriented towards the first actuating sleeve 110. The front side of the deflecting sleeve 107 which is oriented towards the front end 103 of the mandrel 102 comprises a second cam follower 120 that engages within the linear guiding means 118 which is fixed in the second sleeve section 106*b* of the orienting sleeve. The linear guiding means 118 is prevented to rotate together with the second actuating sleeve so that the rotation of the second actuating sleeve 114 causes the deflecting sleeve 107 to translate along the said second axis 137 of the bore of the second sleeve section 106*b* of the orienting sleeve 106. This action deflects the mandrel 102 from a position parallel to the axis 101 of the housing 136 to a second position inclined relative to the axis 101 of the housing 136. The bearing pack arranged between the deflecting sleeve 107 and the mandrel 102 allows free rotation of the mandrel 102 relative to the deflecting sleeve 107 and to the orienting sleeve 106 and provides structural coupling between the parts.

Alternative embodiments of a deflecting assembly including various embodiment of a deflecting sleeve 107 and means for pushing the deflecting sleeve 107 along the said second axis 137 can be envisaged by the man skilled in the art such as for example a deflecting sleeve actuated by piston means or scissors powered by a motor.

To orient the mandrel 102 towards a desired direction or in other words to change the tool face of the drill bit, instructions are sent to the control electronic assembly 125, for example via telemetry transmitters, for actuating the first geared actuator 108 for rotating the orienting sleeve 106. The control electronics may also operate and provide directional control independent of surface commands via preprogrammed computer algorithms.

In a preferred embodiment of the present invention, the housing 136 of the steering assembly comprises an enclosure for a first motor 126 connected to the first geared actuator 108 dedicated for rotating the said orienting sleeve 106, and for a second motor 127 connected to the second geared actuator 113 dedicated for rotating the first actuating sleeve 110 of the actuating system for actuating the deflecting sleeve 107. In such an embodiment, it is therefore possible to send instructions for deflecting the mandrel at a desired offset position relative to the axis 101 of the housing 136 while rotating the mandrel 102 about the axis 101 of the housing 136 to orient the mandrel towards a desired direction, or in other words, to change the tool face of the mandrel towards a desired angle. Such a steering assembly provides a better control of the tool face orientation and provides borehole doglegs of better quality.

The housing 136 is advantageously configured for not rotating in the wellbore, for example by providing on the external surface of the housing a plurality of stabilizer pads 122 adapted to contact the walls of the wellbore. The pads 122 may have a rugged contact surface or can be made of rubber material to provide friction with the wall of the wellbore and preventing rotation of the housing. It is preferred that the housing 136 is in a position independent from the rotation of the mandrel, the tool face assembly and the deflecting assembly, such that the housing 136 serves as a reference point for steering. The steering assembly of the present invention allows an easier control of the tool face over the whole range of 360°. The steering assembly of the present invention also allows the offset of the front extremity of the mandrel to be varied to generate a variation of doglegs from small doglegs to high doglegs. The flexibility of the steering assembly is due to the pivot stabilizer and that creates a pivot point for the mandrel about which the mandrel rotates. This flexibility allows high doglegs.

Despite that the housing is configured for not rotating in the wellbore and is provided advantageously with stabilizer pads 122, it can happen that the housing accidentally rotates in the wellbore due for example to undesirable friction through the bearings. In order to prevent undesirable steering deviations, the housing 136 of the steering assembly is preferably equipped by a controller including accelerometers or other measuring means for measuring the deviation of the housing 136 relative to its initial tool face and the gravity vector. The controller is preferably included in the control electronics assembly 125, and is configured for measuring deviations of the housing angular position, for computing corrections to apply to the deflecting assembly and to the tool face assembly in order to steer the bit according to the desired direction and for applying these corrections to the deflecting assembly and to the tool face assembly.

A steering assembly 100 according to a second embodiment of the present invention comprises a housing 136 having a longitudinal axis 101 and a mandrel 102 comprising a front connecting extremity 103 and a rear connecting extremity 104, the mandrel 102 passing through the said housing 136 and arranged in a first position coaxially to the said longitudinal axis 101, a deflector device for giving a side force to the said mandrel 102 in the housing 136 such as to bring the said front connecting extremity 103 of the said mandrel 102 offset from the said longitudinal axis 101, characterized in that it further comprises a pivot stabilizer 131 connected to the rear extremity 104 of the mandrel. The pivot stabilizer sub 131 gives more flexibility to the steering assembly. The deflector device can be any deflector device known in the art such as a set of pistons or pads pushing the mandrel 102 offset from the longitudinal axis 101 of the housing 136, or the deflector device can be a deflecting assembly as disclosed herein above. Upon a side force on the mandrel 102, the mandrel 102 rotates about the pivot point of the pivot stabilizer and bending of the mandrel is prevented. Thanks to that feature also, a wellbore can be drilled with higher doglegs.

Preferably, the said pivot stabilizer is arranged outside of the housing 136. The steering assembly is simpler to build, comprises less parts in the housing, and removal of the pivot stabilizer sub is facilitated for maintenance.

In another configuration of the second embodiment of the invention, the front extremity 103 of the mandrel 102 is connected to a pivot sub 135 which is connected to a near bit stabilizer sub 133 which is connected to a drill bit 200.

Preferably, the said housing 136 is configured for not rotating within the wellbore and serves as a reference point for steering the bit.

Preferably, the steering assembly comprises:

a deflecting assembly for giving a side force to the said mandrel 102 into the housing 136 such as to bring the said front connecting extremity 103 of the said mandrel 102 offset from the said longitudinal axis 101, and a tool face assembly for rotating the said front connecting extremity 103 of the said mandrel 102 towards a desired direction;

the said mandrel 102 being rotatable relative to the said housing, the said deflecting assembly and the said tool face assembly.

Preferably, the steering assembly comprises a control device configured for measuring any undesirable rotation of the housing in the wellbore, calculating the correction to apply to steer the bit in the desired direction and to apply these corrections to the said deflecting assembly and tool face assembly.

Preferably, the tool face assembly and the deflecting assembly may comprise any one of the features listed herein above for the steering assembly according to the first embodiment of the present invention.

Preferably, the second embodiment of the steering assembly comprises any one of the features of the first embodiment of the present invention.

According to a second aspect, the present invention is related to a method for drilling directionally wellbore by providing in a drillstring a steering assembly 100 according to any one of the aforementioned embodiments, and wherein the direction of drilling is changed by operating the said deflecting assembly.

Preferably, the direction of drilling is further changed by operating the said tool face assembly.

More preferably, the direction of drilling is changed by operating in the same time the deflecting assembly and the tool face assembly.

In an embodiment of the method of the present invention, the steering assembly 100 is used in a push the bit configuration with the said front extremity 103 of the mandrel 102 connected to a drill bit 200.

In an alternative embodiment of the present invention, the steering assembly 100 is used in a point the bit configuration wherein the said front extremity 103 of the mandrel 102 is connected to a pivot sub 135 which is connected to a near bit stabilizer 133 having blades 134 away from the pivot point 139 of the pivot sub 135, the near bit stabilizer 133 being connected to a drill bit 200.

Also, a first section of a wellbore can be drilled by using the steering assembly in a push the bit configuration and a second section of a wellbore can be drilled by using the steering assembly in a point the bit configuration or inversely.

Steering Assembly Using Deflection Assembly and Tool Face Sleeve

In another implementation, a steering assembly may be used in a drill string for steering a drill bit in a directional wellbore, where the steering assembly may include a deflection assembly and a tool face sleeve. Similar to the components of the steering assembly 100, the deflection assembly may be used to deflect a mandrel at a desired offset position relative to an axis of the steering assembly, and the tool face sleeve may be used to orient the mandrel towards a desired direction (i.e., change a tool face angle of the mandrel), as further described below.

Figure 6:
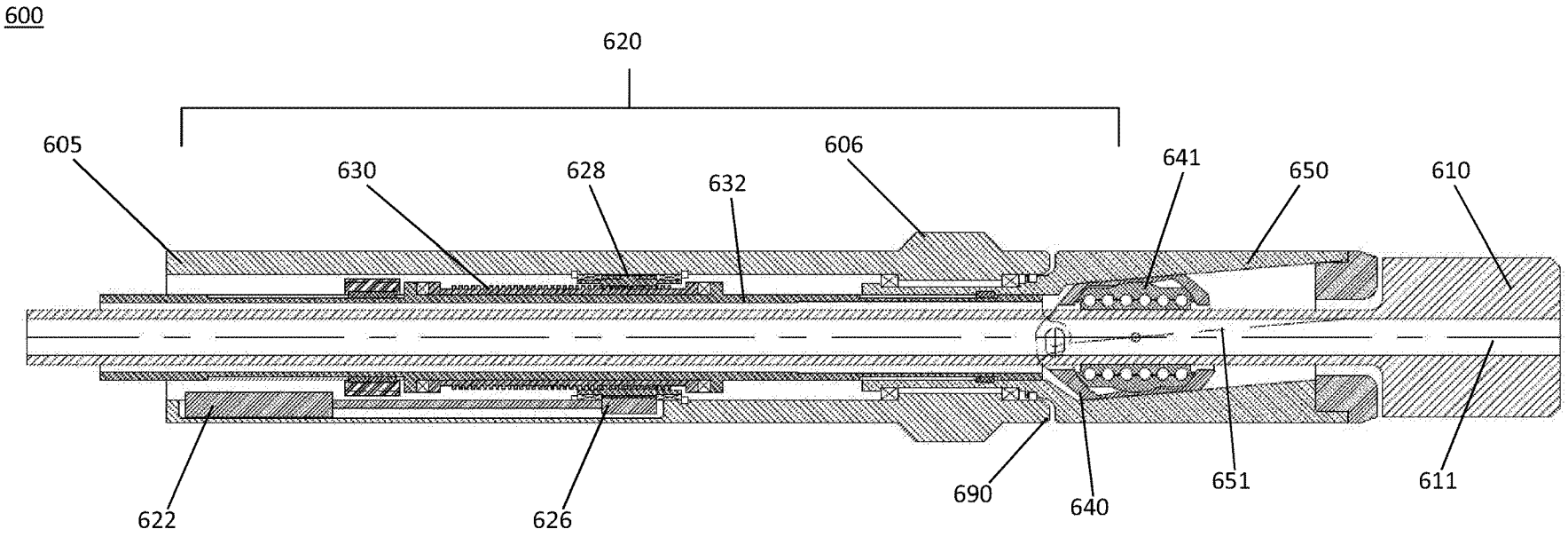
FIG. 6 illustrates a cross-sectional view of a portion of a steering assembly in accordance with implementations of various techniques described herein.

For example, FIG. 6 illustrates a cross-sectional view of a portion of a steering assembly 600 in accordance with implementations of various techniques described herein. As shown, the steering assembly 600 may include a housing 605 and a mandrel 610, where the mandrel 610 may be disposed within and configured to pass through the housing 605. The mandrel 610 may also be rotatable relative to the housing 605. Further, the housing 605 may have a longitudinal axis (not shown) that is similar to the longitudinal axis 101 described above, and the mandrel 610 may have a mandrel axis 611 that is similar to the mandrel axis 101' described above. In one implementation, the housing 605 may be configured to not rotate within the wellbore, similar to the housing 136 described above. In one such implementation, one or more pads 606 (similar to pads 122) may be used to prevent such rotations and to centralize this housing 605 in the borehole.

The mandrel 610 may be similar to the mandrel 102, described above, in that it may have a front connecting extremity configured to couple to a drill bit (not shown), and it may have a rear connecting extremity configured to couple to a drill string (not shown). The front connecting extremity may be positioned farther downhole relative to the rear connecting extremity.

As is also shown, the steering assembly 600 may include a deflection assembly 620 and a tool face sleeve 650. As mentioned above, the deflection assembly 620 may be configured to deflect the mandrel 610 at a desired offset position relative to the longitudinal axis of the housing 605. In addition, the tool face sleeve 650 may be configured to orient the mandrel 610 towards a desired direction (i.e., change a tool face angle of the mandrel 610).

The portion of the steering assembly 600 shown in FIG. 6 may be similar to the second section of the steering assembly 100 shown in FIG. 2*b* and as described above. In particular, though not shown in FIG. 6, the rear connecting extremity of the mandrel 610 may be similarly coupled to a pivot stabilizer sub, and/or the front connecting extremity of the mandrel 610 may be similarly coupled to a pivot sub, near bit stabilizer, blades, and/or the drill bit. Further, though not shown in FIG. 6, the mandrel 610 may be similarly coupled to the housing 605 via a spherical seat and bearings. Additionally, though not shown in FIG. 6, the steering assembly 600 may similarly include compartments, enclosures, batteries, and control electronic assemblies configured to communicate with the surface and to operate one or more motors described below. These compartments, enclosures, batteries, and control electronic assemblies may be disposed inside the housing 605 at a position uphole relative to the portion of the steering assembly 600 shown in FIG. 6.

Similar to the steering assembly 100, the steering assembly 600 may include a controller and/or computing system configured to measure deviations of the housing angular position, to compute corrections to apply to the deflection assembly and to the tool face sleeve in order to steer the bit according to the desired direction, and to apply these corrections to the deflection assembly and to the tool face sleeve. Any sensors known to those skilled in the art may be used to steer the bit and/or measure such deviations.

As shown in FIG. 6, the tool face sleeve 650 may be coupled to an inner surface of the housing 605 and configured to be arranged around the mandrel 610. In one implementation, the tool face sleeve 650 may be positioned proximate to the front connecting extremity (not shown) of the mandrel 610. A bore of the tool face sleeve 650 may have an axis 651, which may hereinafter be referred to as a deflection axis, that is inclined relative to the longitudinal axis of the housing 605. The deflection axis 651 may be similar in functionality and location to the second axis 137 described above with respect to FIGS. 2*b*-5. As further described later, an inner surface of the tool face sleeve 650 may be coupled to an outer surface of a deflection sleeve 632.

In addition, and as further described later, the tool face sleeve 650 may be rotated, which may orient the mandrel 610 towards a desired direction (i.e., change a tool face angle of the mandrel 610). Other components used to operate the tool face sleeve 650 may not be shown in FIG. 6, but are discussed later.

As also shown in FIG. 6, the deflection assembly 620 may include a deflection motor 622, a deflection gear 626, a ring gear 628, a lead screw 630, the deflection sleeve 632, and a bearing carriage 640. The deflection assembly 620 may include other components, as further described later. The deflection sleeve 632 may be configured to be at least partially disposed within the housing 605, and may also be configured to be arranged around the mandrel 610. In particular, a bore of the deflection sleeve 632 may be coaxial with the longitudinal axis of the housing 605. As explained below, components of the deflection assembly 620 may be used to translate the deflection sleeve 632 along the longitudinal axis of the housing 605.

As shown, a downhole portion of the deflection sleeve 632 may be coupled to the bearing carriage 640. The deflection sleeve 632 may be coupled to the bearing carriage 640 using any implementation known to those skilled in the art. For example, an outer surface of the carriage 640 may be coupled to one or more segments of the deflection sleeve 632, where such segments have a narrower outer diameter than the remaining portion of the deflection sleeve 632.

The bearing carriage 640 may be disposed within the inclined bore of the tool face sleeve 650, and may also be configured to be arranged around the mandrel 610. The carriage 640 may be coaxial with the deflection axis 651, such that the carriage 640 may be configured to move within the tool face sleeve 650 along its deflection axis 651.

In some implementations, the bearing carriage 640 may be similar in design and construction to the assembly represented by the deflecting sleeve 107, spherical seat 121*a*, and the ball bearing 121*b* discussed above. In particular, a spherical seat 641 and a ball bearing of the carriage 640 may be configured to allow free rotation of the mandrel 610 within the carriage 640.

As such, the mandrel 610 may be deflected by the carriage 640 as the bearing carriage 640 translates along the deflection axis 651 of the tool face sleeve 650. As further described below, components of the deflection assembly 620 may be used to translate the deflection sleeve 632 along the longitudinal axis of the housing 605, which, in turn, may lead to a translation of the carriage 640 and a deflection of the mandrel 610.

Deflection Assembly

Figure 7:
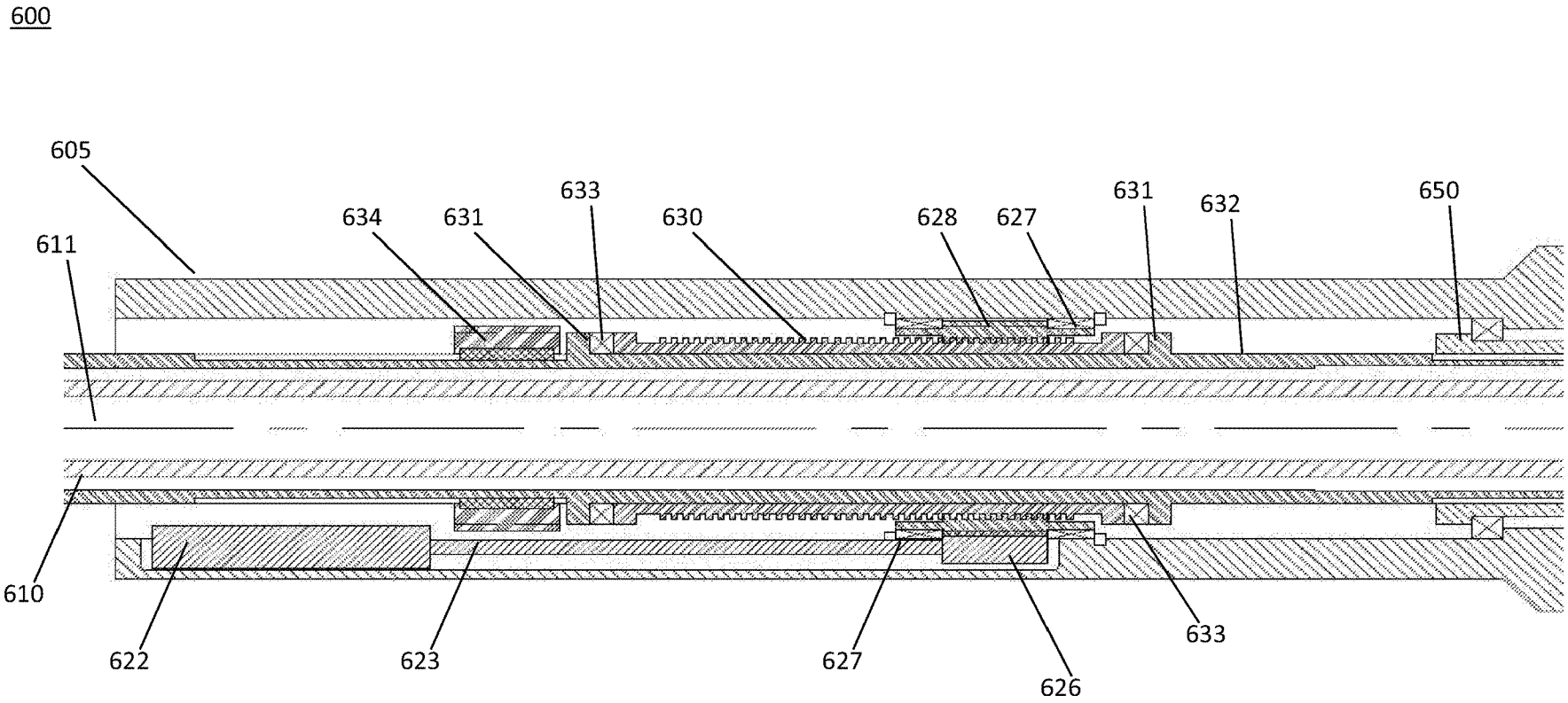
FIG. 7 illustrates a cross-sectional enlarged view of the steering assembly in accordance with implementations of various techniques described herein.

Implementations regarding deflecting the mandrel 610 at a desired or predetermined offset position relative to the longitudinal axis of the housing 605 are further described below. FIG. 7 illustrates a cross-sectional enlarged view of the steering assembly 600 in accordance with implementations of various techniques described herein. In particular, FIG. 7 illustrates further components of the deflection assembly 620.

As shown, the deflection motor 622 may be included within the housing 605, such as in one or more enclosures or compartments along an inner surface of the housing 605. In one implementation, the deflection motor 622 may be positioned proximate to the control electronics assemblies of the steering assembly 600 in order to facilitate communication between the motor 622 and the control electronics assemblies.

A shaft 623 may extend downhole to the deflection gear 626, where the shaft 623 may be used to operate the deflection gear 626. The deflection gear 626 may be any gear known in the art, including a pinion gear. In one implementation, the motor 622 may drive and/or rotate the shaft 623 in order to drive and/or rotate the deflection gear 626. In one implementation, when the motor 622 is operating, both the shaft 623 and the deflection gear 626 may rotate about an axis that is parallel to the longitudinal axis (not pictured) of the housing 605.

An outer surface of the deflection gear 626 may be configured to engage with an outer diameter of the ring gear 628. The ring gear 628 may be held in place using one or more bearings 627 coupled to the inner surface of the housing 605. In particular, using the bearings 627, the ring gear 628 may be configured to rotate around the longitudinal axis (not pictured) of the housing 605 while avoiding any translational movement along the longitudinal axis. Further, the outer diameter of the ring gear 628 may be geared in such a manner that the ring gear 628 is configured to rotate as the deflection gear 626 rotates. In one implementation, an inner diameter of the ring gear 628 may be threaded, where any threading known to those skilled in the art may be used. In another implementation, the inner diameter of the ring gear 628 may be rotationally coupled to a sleeve (not shown), where the sleeve may have an inner diameter that is threaded.

In one implementation, the lead screw 630 may be disposed on the inner diameter of the ring gear 628, such that an outer diameter of the lead screw 630 is configured to threadably engage with the threaded inner diameter of the ring gear 628. In another implementation, the lead screw 630 may be disposed on the inner diameter of a sleeve that is rotationally coupled to the inner diameter of the ring gear 628, such that an outer diameter of the lead screw 630 is configured to threadably engage with the threaded inner diameter of the sleeve. Furthermore, the lead screw 630 may be keyed (not shown) to the outer housing 605 such that rotation is prevented, but linear translation is allowed. In one implementation, the outer diameter of the lead screw 630 may be threaded in a similar manner as the inner diameter of the ring gear 628.

As such, as the ring gear 628 rotates, the threaded engagement with the lead screw 630, along with the rotational constraint imposed from the key between the lead screw 630 and outer housing 605, cause the lead screw 630 to translate along the longitudinal axis of the housing 605. Moreover, the lead screw 630 may translate in a particular direction within the housing 605 based on a particular direction of the rotation of the ring gear 628.

Additionally, as shown in FIG. 7, the lead screw 630 may be configured to be arranged around the deflection sleeve 632 and the mandrel 610. In one implementation, as the lead screw 630 translates along the longitudinal axis, the deflection sleeve 632 may be configured to translate in a same direction. As shown, the lead screw 630 may be disposed around the deflection sleeve 632 between a pair of abutments 631 protruding from an outer surface of the deflection sleeve 632. In addition, a pair of bearings 633 may be positioned between the abutments 631 and each end of lead screw 630. An abutment 631 may represent a shoulder extending from the outer surface of the deflection sleeve 632, a snap ring, or any other implementation known to those skilled in the art. The bearings 633 may be any bearings know to those skilled in the art.

As such, as the lead screw 630 translates along the longitudinal axis due to a rotation of the ring gear 628, an end of the lead screw 630 may come into contact with an abutment and/or bearing 633 of the deflection sleeve 632. Accordingly, the translation of the lead screw 630 may cause the deflection sleeve 632 to move in conjunction with the lead screw 630. In one implementation, the translation of the deflection sleeve 632 may be limited to a travel distance between a downhole end of a ring gear 634 and an uphole end of the tool face sleeve 650 within the housing 605, where the abutments 631 of the sleeve 632 may contact the ring gear 634 or the uphole end of the tool face sleeve 650. The ring gear 634 may be positioned farther uphole than the tool face sleeve 650. The ring gear 634 is described in further detail in a later section.

In a further implementation, the lead screw 630 and the deflection sleeve 632 may rotate independently of each other. In particular, due to a clearance between an inner diameter of the lead screw 630 and an outer diameter of the deflection sleeve 632, along with the presence of the bearings 633, the lead screw 630 may rotate freely around the deflection sleeve 632, and the deflection sleeve 632 may similarly rotate freely within the lead screw 630. As such, it may be said that the lead screw 630 and the deflection sleeve 632 may be axially coupled to one another, but not rotationally coupled.

In addition, as noted above, a portion of the deflection sleeve 632 may be coupled to the bearing carriage 640. As such, a translational movement of the lead screw 630 may lead to the deflection sleeve 632 pushing the bearing carriage 640 in the same direction. However, due to the inclined nature of the bore of the tool face sleeve 650, the bearing carriage 640 may move along the deflection axis 651 of the sleeve 650. In one implementation, as the bearing carriage 640 moves along the deflection axis 651 in a downhole direction, the bearing carriage 640 may apply a side force to the mandrel 610, thereby deflecting the axis 611 of mandrel 610 relative to the longitudinal axis of the housing 605. Accordingly, the deflection assembly 620 and its components (e.g., the ring gear 628, the lead screw 630, and the deflection sleeve 632) can be used to deflect the mandrel 610 at a desired offset position relative to the longitudinal axis of the housing 605.

In one example operation, the components of the steering assembly 600 may initially be positioned as shown in FIGS. 6-7. In particular, the lead screw 630 may be at a first position, such that the most uphole abutment 631 of the deflection sleeve 632 may be positioned proximate to the ring gear 634. Accordingly, deflection sleeve 632 may not have pushed the bearing carriage 640 far into the inclined bore of the tool face sleeve 650. In such instances, the bearing carriage 640 may have applied little to no side force to the mandrel 610, leading to little to no deflection of axis 611 of the mandrel 610 relative to the longitudinal axis of the housing 605. For such instances, the mandrel 610 may be at a zero offset position relative to the longitudinal axis.

Figure 8:
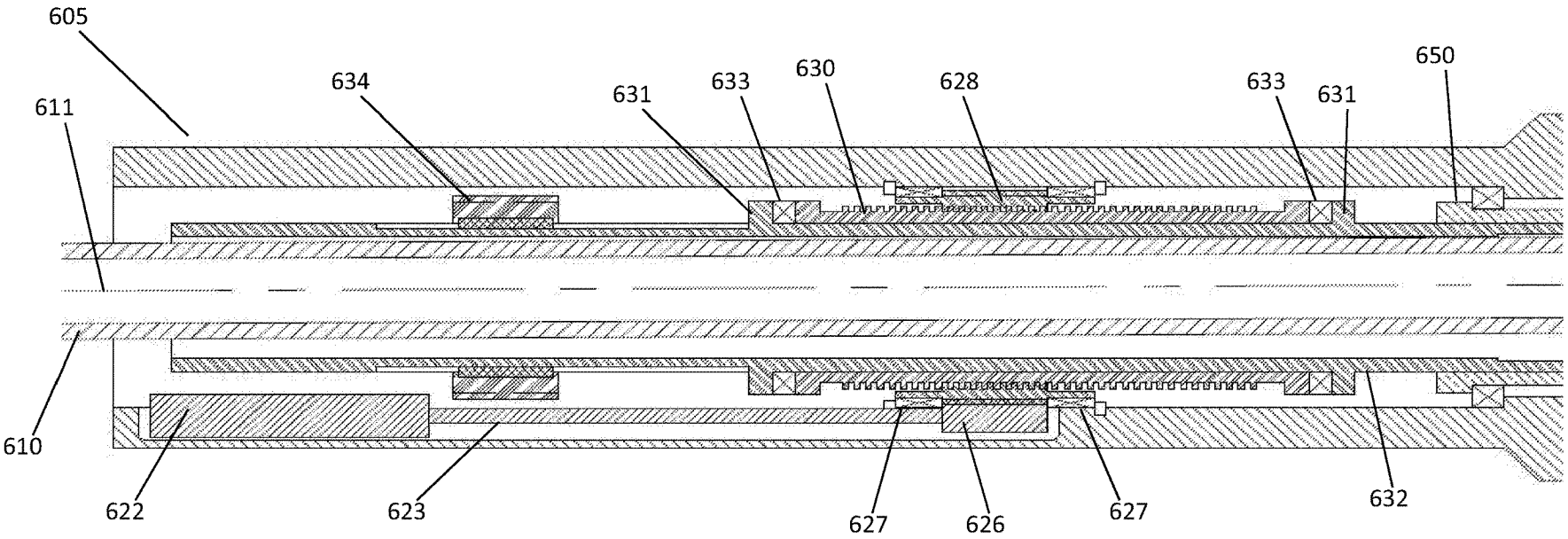
FIG. 8 illustrates a cross-sectional enlarged view of the steering assembly in accordance with implementations of various techniques described herein.
Figure 9:
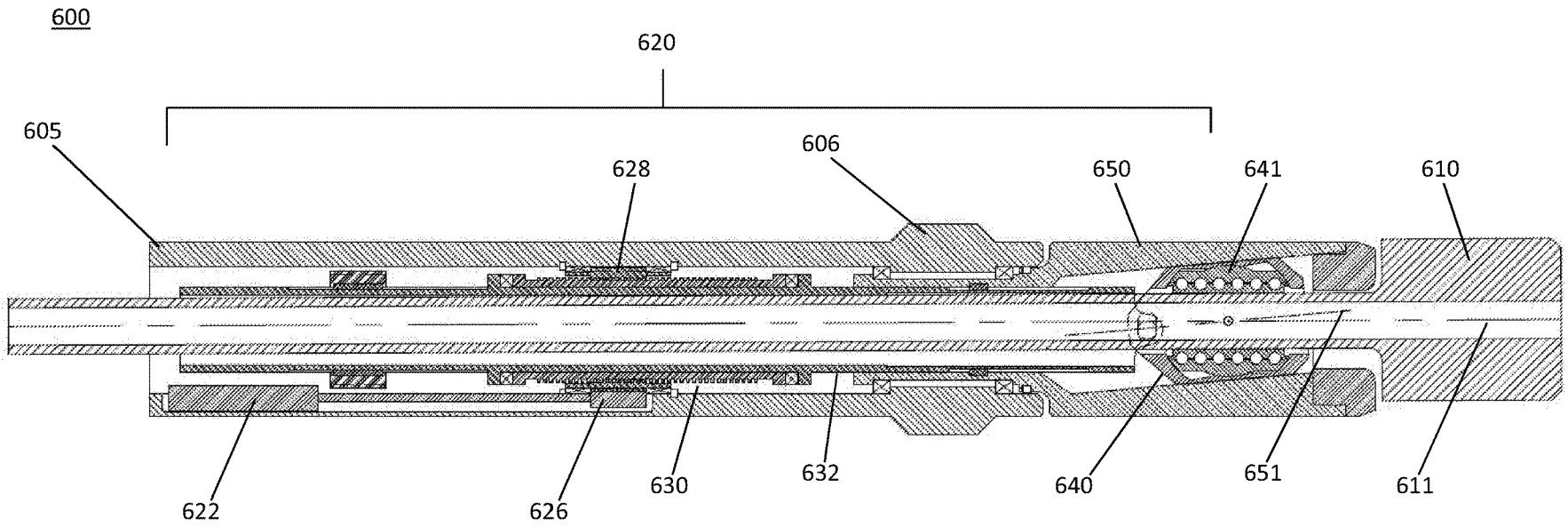
FIG. 9 illustrates a cross-sectional view of a portion of a steering assembly in accordance with implementations of various techniques described herein.

However, the motor 622 may subsequently drive the shaft 623 to rotate the deflection gear 626, thereby causing a rotation of the ring gear 628. As the ring gear 628 rotates, the threaded engagement with the lead screw 630 may lead to a rotation of the lead screw 630 about the longitudinal axis (not pictured) of the housing 605. The lead screw 630 may rotate until it reaches a position as shown in FIGS. 8 and 9. FIG. 8 illustrates a cross-sectional enlarged view of the steering assembly 600 in accordance with implementations of various techniques described herein, and FIG. 9 illustrates a cross-sectional view of a portion of a steering assembly 600 in accordance with implementations of various techniques described herein.

As shown, the lead screw 630 may have translated in a direction farther downhole than its initial position. Accordingly, the deflection sleeve 632 may also have similarly translated farther downhole to a new position in conjunction with the lead screw 630. Moreover, the deflection sleeve 632 may have pushed the bearing carriage 640 as the sleeve 632 moved to this new position. As shown, the bearing carriage 640 may have moved farther downhole along the deflection axis 651 of the sleeve 650, such that the bearing carriage 640 may have applied a side force to the mandrel 610. As a result of the applied side force, the axis 611 of the mandrel 610 has been deflected to an offset position relative to the longitudinal axis of the housing 605, as shown in FIG. 9. By using the deflection assembly 620 to deflect the mandrel 610, the steering assembly 600 may be used to achieve higher doglegs during drilling of the wellbore. In some implementations, a controller or computing system may be used to operate the deflection motor 622 in a particular manner such that the mandrel 610 is deflected to a specified or predetermined offset position relative to the longitudinal axis of the housing 605.

In one implementation, the steering assembly 600 may be sealed along the tool from a position uphole from reference point 690. Such a seal may allow for a portion of the deflection assembly 620, including the deflection motor 622, the deflection gear 626, the ring gear 628, the lead screw 630, at least part of the deflection sleeve 632, and their associated components to operate in a sealed, hydraulic oil-filled volume.

Toolface Sleeve

Figure 10:
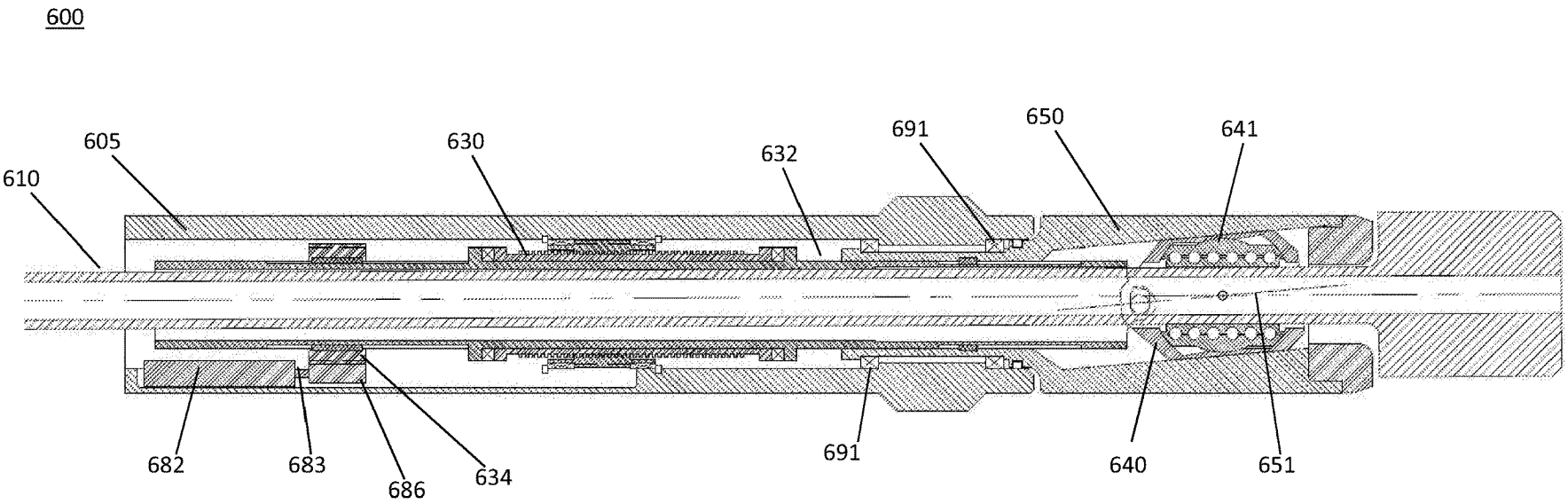
FIG. 10 illustrates a cross-sectional view of the steering assembly in accordance with implementations of various techniques described herein.

Implementations regarding orienting the mandrel 610 towards a desired direction (i.e., change a tool face angle of the mandrel 610) using the tool face sleeve 650 are further described below. For example, FIG. 10 illustrates a cross-sectional view of the steering assembly 600 in accordance with implementations of various techniques described herein. In particular, FIG. 10 illustrates the tool face sleeve 650 and further associated components. Further, FIG. 10 shows a tool face motor 682, a shaft 683, a tool face gear 686, a ring gear 634, the lead screw 630, the deflection sleeve 632, the bearing carriage 640, the tool face sleeve 650, and bearings 691.

Figure 11:
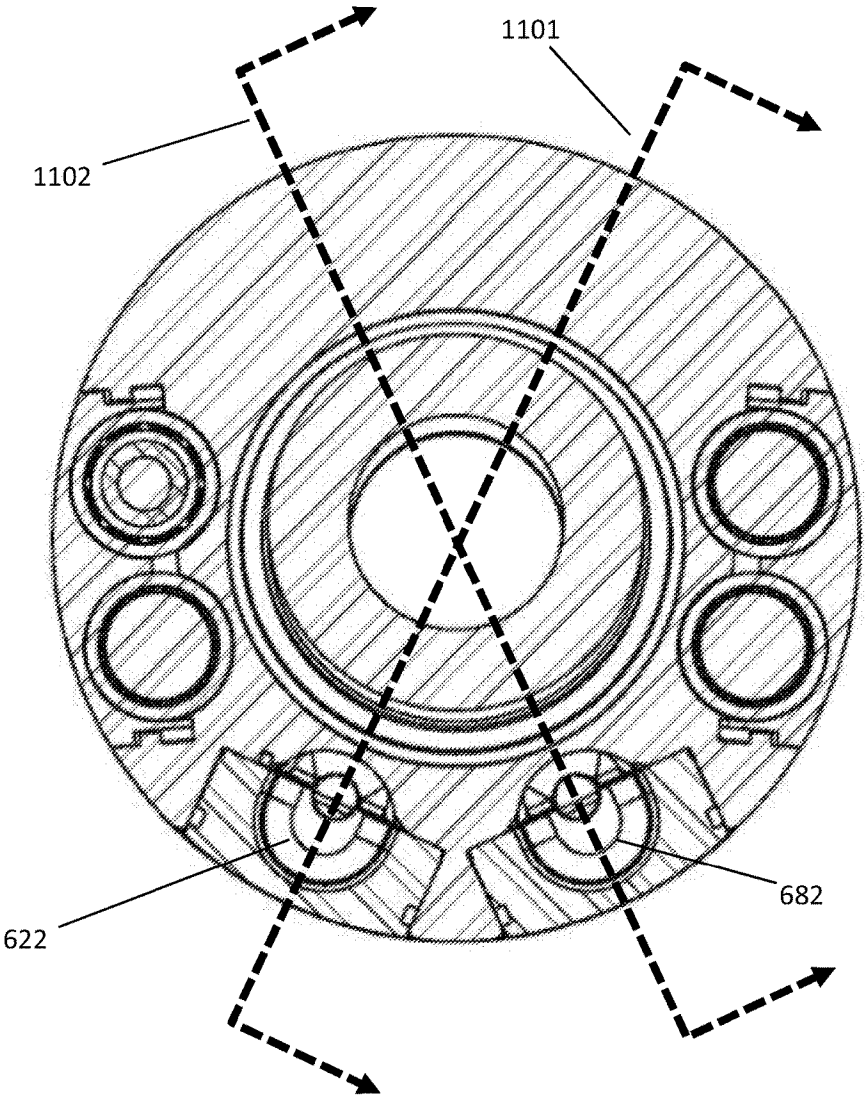
FIG. 11 illustrates a front cross-sectional view of the steering assembly in accordance with implementations of various techniques described herein.
Figure 12:
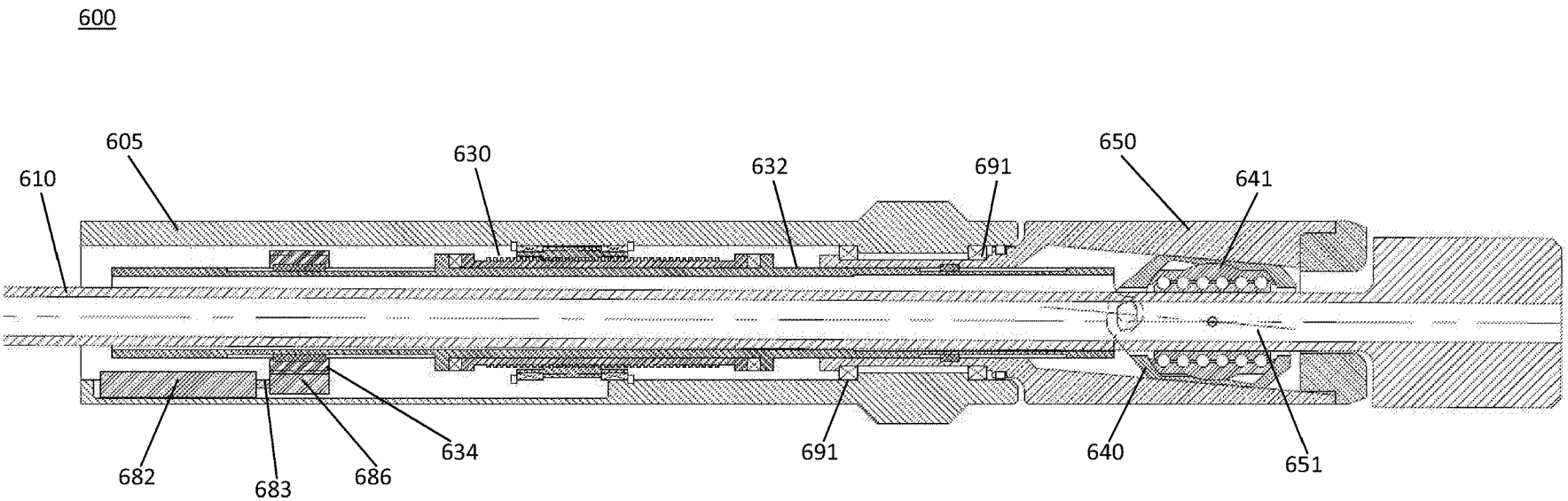
FIG. 12 illustrates a cross-sectional view of the steering assembly in accordance with implementations of various techniques described herein.

It should be noted that FIG. 10 illustrates a different cross-section of the tool than that illustrated in FIGS. 6-9. In particular, as shown in FIG. 11, a line 1101 may bisect the assembly 600 such that a cross-section of the assembly 600 through the motor 622 is shown. This is represented in FIGS. 6-9. Further, a line 1102 may bisect the assembly 600 such that a cross-section of the assembly 600 through the motor 682 is shown. This is represented in FIGS. 10 and 12. FIG. 11 illustrates a front cross-sectional view of the steering assembly 600 in accordance with implementations of various techniques described herein.

As shown in FIG. 10, a tool face motor 682 may be included within the housing 605, such as in one or more enclosure or compartments along an inner surface of the housing 605. In one implementation, the tool face motor 682 may be positioned proximate to the control electronics assemblies of the steering assembly 600 in order to facilitate communication between the motor 682 and the control electronics assemblies.

A shaft 683 may extend downhole to the tool face gear 686, where the shaft 683 may be used to operate the tool face gear 686. The tool face gear 686 may be any gear known in the art, including a pinion gear. In one implementation, the motor 682 may drive and/or rotate the shaft 683 in order to drive and/or rotate the tool face gear 686. In one implementation, when the motor 682 is operating, both the shaft 683 and the tool face gear 686 may rotate about an axis that is parallel to the longitudinal axis (not pictured) of the housing 605.

An outer surface of the tool face gear 686 may be configured to engage with an outer diameter of the ring gear 634. The ring gear 634 may be held in place using one or more bearings. In particular, using the bearings, the ring gear 634 may be configured to rotate around the longitudinal axis (not pictured) of the housing 605 while avoiding any translational movement along the longitudinal axis. Further, the outer diameter of the ring gear 634 may be geared in such a manner that the outer diameter is configured to rotate as the tool face gear 686 rotates. In addition, an inner diameter of the ring gear 634 may be keyed (not shown) to the deflection sleeve 632. As such, as the ring gear 634 rotates, the deflection sleeve 632 may be configured to rotate as well, while avoiding any translational movement along the longitudinal axis.

In addition, the deflection sleeve 632 may configured to be rotationally coupled to the tool face sleeve 650 using any implementation known to those skilled in the art. As such, when the deflection sleeve 632 rotates in a particular direction about the longitudinal axis, then the tool face sleeve 650 may be configured to rotate in the same direction. As shown in FIG. 10, an inner surface of the tool face sleeve 650 may be rotationally coupled to an outer surface of the deflection sleeve 632 within the housing 605. In one implementation, the inner surface of the tool face sleeve 650 may be keyed to the outer surface of the deflection sleeve 632, such that the tool face sleeve 650 rotates together with the deflection sleeve 632. In addition, one or more bearings 691 known to those skilled in the art, such as a thrust bearing, may be arranged between the inner surface of the housing 605 and the tool face sleeve 650.

In one implementation, the tool face sleeve 650 may be similar to the second sleeve section 106*b* of the orienting sleeve 106, as described above with respect to FIGS. 2*a*-4. In particular, an outer surface of the tool face sleeve 650 may be cylindrically coaxial to the longitudinal axis of the housing 605. The tool face sleeve 650 may also have an outer diameter that is configured to prevent debris of the wellbore to penetrate within the housing 605. For example, the outer diameter of the tool face sleeve 650 may be superior or equal to the outer diameter of the end of the housing 605. In another example, the outer diameter of the tool face sleeve 650 may be substantially equal or superior to the inner diameter of the end of the housing 605. Further, because of the inclination of the bore of the tool face sleeve 650, the outer diameter of the tool face sleeve 650 may be superior to the outer diameter of the deflection sleeve 632.

In another implementation, the tool face sleeve 650 may be partially included in the housing 605, with the deflection sleeve 632 arranged inside of the housing 605 and the tool face sleeve 650 arranged outside of the housing 605. In a further implementation, the tool face sleeve 650 may be rotatable relative to the housing 605.

To change a desired direction of the mandrel 610 (i.e., change a tool face angle of the mandrel 610), the tool face motor 682, the shaft 683, the tool face gear 686, the ring gear 634, the deflection sleeve 632, the bearing carriage 640, and the tool face sleeve 650 may be used. In particular, the tool face motor 682 may be used to rotate the deflection sleeve 632, as mentioned above. In addition, when the deflection sleeve 632 rotates in a particular direction about the longitudinal axis, then the tool face sleeve 650 may be configured to rotate in the same direction. As the tool face sleeve 650 rotates, the deflection axis 651 of the tool face sleeve 650 may rotate relative to the longitudinal axis of the housing 650. The bearing carriage 640, which may be coaxial with the deflection axis 651, may also rotate with the rotation of the tool face sleeve 650. Accordingly, the angle of the bearing carriage 640 and the deflection axis 651 relative to the longitudinal axis may also change, which may alter the direction at which the mandrel 610 may be deflected relative to the longitudinal axis.

As such, the direction of the mandrel 610 may change as the tool face sleeve 650 rotates. Accordingly, the tool face motor 682, the deflection sleeve 632, the tool face sleeve 650, and their associated components may be used to change the direction of the mandrel 610 (i.e., change a tool face angle of the mandrel 610). In one implementation, the deflection sleeve 632 may bear most of the torsional load relative to the other components of the steering assembly 600 when changing a tool face angle of the mandrel 610.

In one example operation, the components of the steering assembly 600 may initially be positioned as shown in FIG. 10. The motor 682 may drive the shaft 683 to rotate the tool face gear 686, thereby causing a rotation of the ring gear 634. As the ring gear 634 rotates, the deflection sleeve 632 may rotate in a similar fashion. Likewise, a rotation of the deflection sleeve 632 may lead to a rotation of the coupled tool face sleeve 650, thereby rotating the deflection axis 651 of sleeve 650 relative to the longitudinal axis. For example, the tool face sleeve 650 and its deflection axis 651 may have rotated 180 degrees, as shown in FIG. 12. FIG. 12 illustrates a cross-sectional view of the steering assembly 600 in accordance with implementations of various techniques described herein. In such an example, where a deflected mandrel 610 has rotated 180 degrees, the tool face angle of the mandrel may have also changed 180 degrees.

As mentioned above, the lead screw 630 and the deflection sleeve 632 may rotate independently of each other. In particular, due to a clearance between an inner diameter of the lead screw 630 and an outer diameter of the deflection sleeve 632, along with the bearings 633, the lead screw 630 may rotate freely around the deflection sleeve 632, and the deflection sleeve 632 may similarly rotate freely within the lead screw 630. Accordingly, rotating the tool face sleeve 650 and the deflection sleeve 632 for purposes of changing a tool face angle of the mandrel 610 may have no effect on the rotation of the lead screw 630, as the lead screw 630 may rotate independently of the tool face sleeve 650 and the deflection sleeve 632. As such, changing the tool face angle of the mandrel 610 may have no effect on the translation of the lead screw 630, deflection sleeve 632, or bearing carriage 640, which means the deflection of the mandrel 610 is unaffected.

In some implementations, a controller or computing system may be used to operate the tool face sleeve 650 and associated components (e.g., motor 682, deflection sleeve 632, etc.) in a particular manner such that the mandrel 610 is oriented to a specified or predetermined direction (i.e., a specified or predetermined tool face angle). Further, as mentioned above, the steering assembly 600 may be sealed from a position uphole from reference point 690. Such a seal may allow for the coupling of the deflection sleeve 632 and the tool face sleeve 650 to be positioned within a sealed, hydraulic oil-filled volume.

Implementations relating to a steering assembly used in a drill string for steering a drill bit in a directional wellbore are disclosed herein. In particular, the steering assembly may include a deflection assembly used to deflect a mandrel at a desired offset position relative to an axis of the steering assembly, and may include a tool face sleeve used to orient the mandrel towards a desired direction (i.e., change a tool face angle of the mandrel).

In one implementation, a lead screw and a deflection sleeve may rotate independently of each other. In particular, the lead screw may rotate freely around the deflection sleeve, and the deflection sleeve may similarly rotate freely within the lead screw. As such, it may be said that the lead screw and the deflection sleeve may be axially coupled to one another, but not rotationally coupled.

Accordingly, rotating the tool face sleeve and the deflection sleeve for purposes of changing a tool face angle of the mandrel may have no effect on the rotation of the lead screw, as the lead screw may rotate independently of the tool face sleeve and the deflection sleeve. As such, changing the tool face angle of the mandrel may have no effect on the translation of the lead screw, deflection sleeve, or bearing carriage, which means the deflection of the mandrel is unaffected. It follows that implementations for the steering assembly described herein may consume less power than other assemblies in which changing a tool face angle may affect a deflection of the mandrel. For those other assemblies, both the tool face and deflection mechanisms would need to be operated to avoid a change in deflection of the mandrel. This may particularly be an issue for those other assemblies in which tool face angle is changed often, while deflection may be held for longer periods.

Furthermore, as described above, many components of the steering assembly described herein may be disposed within a sealed, hydraulic oil-filled volume. Other assemblies may position such components in mud, which may be less clean than hydraulic oil. By using hydraulic oil rather than mud, the implementations described herein may allow for improved reliability, improved service life, finer pitch lead screws, finer positioning of deflection of the mandrel, less stress on the electric motor, and better resistance to backdriving the motor and gear device.

Computing System

Figure 13:
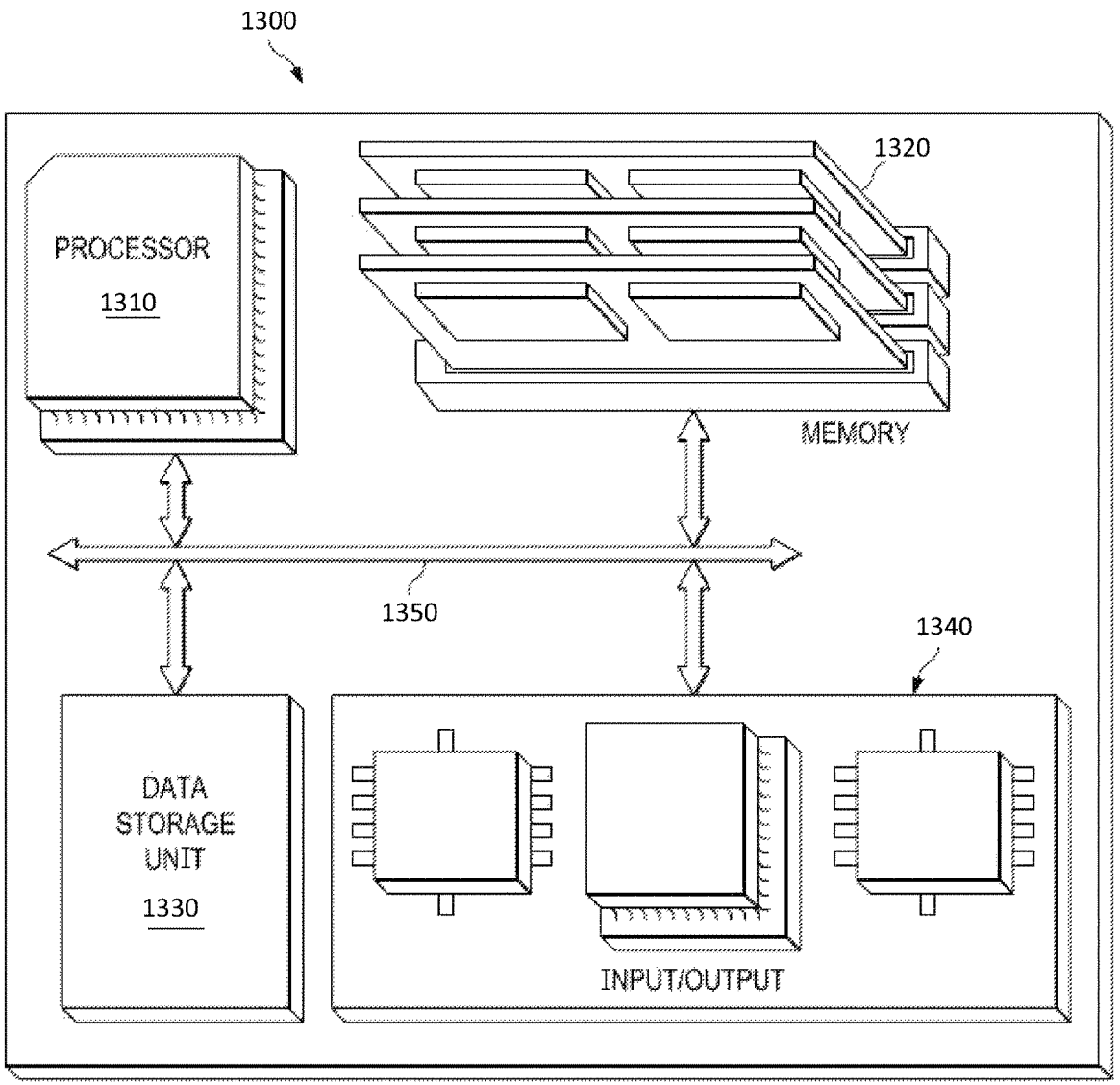
FIG. 13 illustrates a block diagram of a hardware configuration in which one or more various technologies described herein may be incorporated and practiced.

FIG. 13 illustrates a block diagram of a hardware configuration 1300 in which one or more various technologies described herein may be incorporated and practiced. The hardware configuration 1300 can be used to implement the computing system and/or controller discussed above. The hardware configuration 1300 can include a processor 1310, a memory 1320, a storage device 1330, and an input/output device 1340. Each of the components 1310, 1320, 1330, and 1340 can, for example, be interconnected using a system bus 1350. The processor 1310 can be capable of processing instructions for execution within the hardware configuration 1300. In one implementation, the processor 1310 can be a single-threaded processor. In another implementation, the processor 1310 can be a multi-threaded processor. The processor 1310 can be capable of processing instructions stored in the memory 1320 or on the storage device 1330.

The memory 1320 can store information within the hardware configuration 1300. In one implementation, the memory 1320 can be a computer-readable medium. In one implementation, the memory 1320 can be a volatile memory unit. In another implementation, the memory 1320 can be a non-volatile memory unit.

In some implementations, the storage device 1330 can be capable of providing mass storage for the hardware configuration 1300. In one implementation, the storage device 1330 can be a computer-readable medium. In various different implementations, the storage device 1330 can, for example, include a hard disk device/drive, an optical disk device, flash memory or some other large capacity storage device. In other implementations, the storage device 1330 can be a device external to the hardware configuration 1300. Various implementations for the memory 1320 and/or the storage device 1330 are further discussed below.

The input/output device 1340 can provide input/output operations for the hardware configuration 1300. In one implementation, the input/output device 1340 can include one or more display system interfaces, sensors and/or data transfer ports.

The subject matter of this disclosure, and/or components thereof, can be realized by instructions that upon execution cause one or more processing devices to carry out the processes and functions described above. Such instructions can, for example, comprise interpreted instructions, such as script instructions, e.g., JavaScript or ECMAScript instructions, or executable code, or other instructions stored in a computer readable medium.

Implementations of the subject matter and the functional operations described in this specification can be provided in digital electronic circuitry, or in computer software, firmware, or hardware, including the structures disclosed in this specification and their structural equivalents, or in combinations of one or more of them. Embodiments of the subject matter described in this specification can be implemented as one or more computer program products, i.e., one or more modules of computer program instructions encoded on a tangible program carrier for execution by, or to control the operation of, data processing apparatus.

A computer program (also known as a program, software, software application, script, or code) can be written in any form of programming language, including compiled or interpreted languages, or declarative or procedural languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output thereby tying the process to a particular machine, e.g., a machine programmed to perform the processes described herein. The processes and logic flows can also be performed by, and apparatus can also be implemented as, special purpose logic circuitry, e.g., an FPGA (field programmable gate array) or an ASIC (application specific integrated circuit).

Computer readable media (e.g., memory 1320 and/or the storage device 1330) suitable for storing computer program instructions and data may include all forms of non-volatile memory, media, and memory devices, including, by way of example, any semiconductor memory devices (e.g., EPROM, EEPROM, solid state memory devices, and flash memory devices); any magnetic disks (e.g., internal hard disks or removable disks); any magneto optical disks; and any CD-ROM and DVD-ROM disks. The processor and the memory can be supplemented by, or incorporated in, special purpose logic circuitry.

The discussion above is directed to certain specific implementations. It is to be understood that the discussion above is only for the purpose of enabling a person with ordinary skill in the art to make and use any subject matter defined now or later by the patent "claims" found in any issued patent herein.

It is specifically intended that the claimed invention not be limited to the implementations and illustrations contained herein, but include modified forms of those implementations including portions of the implementations and combinations of elements of different implementations as come within the scope of the following claims. It should be appreciated that in the development of any such actual implementation, as in any engineering or design project, numerous implementation-specific decisions may be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the claimed invention unless explicitly indicated as being "critical" or "essential."

In the above detailed description, numerous specific details were set forth in order to provide a thorough understanding of the present disclosure. However, it will be apparent to one of ordinary skill in the art that the present disclosure may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both objects or steps, respectively, but they are not to be considered the same object or step.

The terminology used in the description of the present disclosure herein is for the purpose of describing particular implementations only and is not intended to be limiting of the present disclosure. As used in the description of the present disclosure and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context. As used herein, the terms "up" and "down"; "upper" and "lower"; "upwardly" and downwardly"; "below" and "above"; and other similar terms indicating relative positions above or below a given point or element may be used in connection with some implementations of various technologies described herein.

While the foregoing is directed to implementations of various technologies described herein, other and further implementations may be devised without departing from the basic scope thereof. Although the subject matter has been described in language specific to structural features and/or methodological acts, it is to be understood that the subject matter defined in the appended claims is not limited to the specific features or acts described above. Rather, the specific features and acts described above are disclosed as example forms of implementing the claims.

What is claimed is:

1. A steering assembly, comprising:

a housing having a longitudinal axis, wherein the housing is included in a drillstring for use in a wellbore;

a mandrel configured to pass through the housing;

a deflection assembly configured to deflect the mandrel relative to the longitudinal axis, wherein the deflection assembly comprises:

a deflection sleeve configured to deflect the mandrel based on a position of the deflection sleeve along the longitudinal axis within the housing; and a ring gear configured to translate the deflection sleeve along the longitudinal axis to the position; and a tool face sleeve coupled to the deflection sleeve and configured to be arranged around the mandrel, wherein the tool face sleeve comprises an inclined bore having a bearing carriage disposed therein, and wherein the bearing carriage is configured to move axially within the tool face sleeve and to deflect the mandrel relative to the longitudinal axis based on an axial position of the bearing carriage within the inclined bore.

2. The steering assembly of claim 1, wherein the deflection assembly further comprises:

a deflection motor configured to drive a deflection gear, wherein the deflection gear is configured to engage with an outer surface of the ring gear, and wherein the outer surface is geared.

3. The steering assembly of claim 1, wherein the ring gear is configured to rotate around the deflection sleeve and the mandrel in order to translate the deflection sleeve.

4. The steering assembly of claim 1, wherein the deflection assembly further comprises:

a lead screw having an outer diameter threadably coupled to an inner diameter of the ring gear, wherein the ring gear is configured to translate the lead screw along the longitudinal axis as the ring gear rotates around the deflection sleeve.

5. The steering assembly of claim 4, wherein the lead screw and the ring gear are disposed within a volume of hydraulic oil within a sealed portion of the housing.

6. The steering assembly of claim 4, wherein the lead screw is configured to rotate around the deflection sleeve as the lead screw translates along the longitudinal axis.

7. The steering assembly of claim 6, wherein the lead screw is configured to move the deflection sleeve along the longitudinal axis as the lead screw translates along the longitudinal axis.

8. The steering assembly of claim 6, wherein the deflection sleeve is configured to rotate about the longitudinal axis independently of the lead screw rotating around the deflection sleeve.

9. The steering assembly of claim 1, wherein the deflection sleeve is coupled to the bearing carriage, and wherein the deflection sleeve is configured to change the position of the bearing carriage within the inclined bore when the deflection sleeve translates along the longitudinal axis.

10. The steering assembly of claim 1, wherein the tool face sleeve and the deflection sleeve are configured to change a tool face angle of the mandrel when the tool face sleeve and the deflection sleeve rotate about the longitudinal axis.

11. A steering assembly, comprising:

a housing having a longitudinal axis, wherein the housing is included in a drillstring for use in a wellbore;

a mandrel configured to pass through the housing;

a deflection assembly configured to deflect the mandrel relative to the longitudinal axis, wherein the deflection assembly comprises:

a deflection sleeve configured to deflect the mandrel based on a position of the deflection sleeve along the longitudinal axis within the housing; and a lead screw configured to translate the deflection sleeve along the longitudinal axis to the position; and a tool face sleeve coupled to the deflection sleeve and configured to be arranged around the mandrel, wherein the tool face sleeve comprises an inclined bore having a bearing carriage disposed therein, and wherein the bearing carriage is configured to move axially within the tool face sleeve and to deflect the mandrel relative to the longitudinal axis based on an axial position of the bearing carriage within the inclined bore.

12. The steering assembly of claim 11, wherein the deflection assembly further comprises:

a ring gear driven by a deflection motor, wherein the ring gear is configured to rotate around the deflection sleeve and the mandrel in order to translate the deflection sleeve.

13. The steering assembly of claim 12, wherein the lead screw and the ring gear are disposed within a volume of hydraulic oil within a sealed portion of the housing.

14. The steering assembly of claim 12, wherein the lead screw has an outer diameter threadably coupled to an inner diameter of the ring gear, wherein the ring gear is configured to translate the lead screw along the longitudinal axis as the ring gear rotates around the deflection sleeve.

15. The steering assembly of claim 12, wherein the lead screw is configured to rotate around the deflection sleeve as the lead screw translates along the longitudinal axis.

16. The steering assembly of claim 12, wherein the deflection sleeve is configured to rotate about the longitudinal axis independently of the lead screw rotating around the deflection sleeve.

17. A method, comprising:

providing a steering assembly in a drill string, wherein the steering assembly comprises:

a housing having a longitudinal axis, wherein the housing is included in a drillstring for use in a wellbore;

a mandrel configured to pass through the housing;

a deflection assembly configured to deflect the mandrel relative to the longitudinal axis, wherein the deflection assembly comprises:

a deflection sleeve configured to deflect the mandrel based on a position of the deflection sleeve along the longitudinal axis within the housing; and a ring gear configured to translate the deflection sleeve along the longitudinal axis to the position; and a tool face sleeve coupled to the deflection sleeve and configured to be arranged around the mandrel, wherein the tool face sleeve comprises an inclined bore having a bearing carriage disposed therein, and wherein the bearing carriage is configured to move axially within the tool face sleeve and to deflect the mandrel relative to the longitudinal axis based on an axial position of the bearing carriage within the inclined bore; and operating the deflection assembly to deflect the mandrel relative to the longitudinal axis.

18. The method of claim 17, wherein the deflection assembly further comprises:

a lead screw having an outer diameter threadably coupled to an inner diameter of the ring gear, wherein the ring gear is configured to translate the lead screw along the longitudinal axis as the ring gear rotates around the deflection sleeve.

19. The steering assembly of claim 18, wherein the deflection sleeve is configured to rotate about the longitudinal axis independently of the lead screw rotating around the deflection sleeve.

* * * * *